US011495449B2

(12) United States Patent
Jarrold et al.

(10) Patent No.: US 11,495,449 B2
(45) Date of Patent: Nov. 8, 2022

(54) ORBITRAP FOR SINGLE PARTICLE MASS SPECTROMETRY

(71) Applicant: THE TRUSTEES OF INDIANA UNIVERSITY, Bloomington, IN (US)

(72) Inventors: Martin F. Jarrold, Bloomington, IN (US); Aaron R. Todd, Bloomington, IN (US)

(73) Assignee: The Trustees Of Indiana University, Bloomington, IN (US)

( * ) Notice: Subject to any disclaimer, the term of this patent is extended or adjusted under 35 U.S.C. 154(b) by 0 days.

(21) Appl. No.: 17/293,850

(22) PCT Filed: Jan. 11, 2019

(86) PCT No.: PCT/US2019/013278
§ 371 (c)(1),
(2) Date: May 13, 2021

(87) PCT Pub. No.: WO2020/106310
PCT Pub. Date: May 28, 2020

(65) Prior Publication Data

US 2022/0013349 A1 Jan. 13, 2022

Related U.S. Application Data

(60) Provisional application No. 62/769,952, filed on Nov. 20, 2018.

(51) Int. Cl.
*H01J 49/42* (2006.01)

(52) U.S. Cl.
CPC ..... *H01J 49/425* (2013.01); *H01J 49/4255* (2013.01)

(58) Field of Classification Search
CPC ..... H01J 49/425; H01J 49/4255
(Continued)

(56) References Cited

U.S. PATENT DOCUMENTS 3,019,168 A 1/1962 Taylor
5,285,063 A 2/1994 Schwartz et al.
(Continued)

FOREIGN PATENT DOCUMENTS

WO 1998011244 A1 3/1998
WO 1999061601 A1 12/1999
(Continued)

OTHER PUBLICATIONS

PCT International Search Report and Written Opinion completed by the ISA/US on Jan. 12, 2016 and issued in connection with PCT/US2015/059463.
(Continued)

*Primary Examiner* — Nicole M Ippolito
(74) *Attorney, Agent, or Firm* — Barnes & Thornburg LLP

(57) ABSTRACT

An orbitrap may include elongated inner and outer electrodes, wherein the inner and outer electrodes each define two axially spaced apart electrode halves with a central transverse plane extending through the electrodes also passing between both sets of electrode halves, a cavity defined radially about and axially along the inner electrode between the two inner electrode halves and the two outer electrode halves, means for establishing an electric field configured to trap an ion in the cavity and to cause the trapped ion to rotate about, and oscillate axially along, the inner electrode, wherein the rotating and oscillating ion induces charges on the inner and outer electrode halves, and charge detection circuitry configured to detect the charges induced on the inner and on outer electrode halves, and to combine the detected charges for each oscillation to produce a measured ion charge signal.

20 Claims, 7 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 5,478,745 | A | 12/1995 | Samulski | |
| 5,572,025 | A | 11/1996 | Cotter | |
| 5,770,857 | A | 6/1998 | Fuerstenau et al. | |
| 5,863,541 | A | 1/1999 | Samulski et al. | |
| 5,869,248 | A | 2/1999 | Yuan et al. | |
| 5,877,022 | A | 3/1999 | Stinchcomb et al. | |
| 5,880,466 | A | 3/1999 | Benner | |
| 5,882,652 | A | 3/1999 | Valdes et al. | |
| 5,886,346 | A | 3/1999 | Makarov | |
| 5,905,040 | A | 5/1999 | Mazzara et al. | |
| 5,916,563 | A | 6/1999 | Young et al. | |
| 5,965,358 | A | 10/1999 | Carrion et al. | |
| 6,013,487 | A | 1/2000 | Mitchell | |
| 6,083,702 | A | 7/2000 | Mitchell et al. | |
| 6,156,303 | A | 12/2000 | Russell et al. | |
| 6,183,950 | B1 | 2/2001 | Madonna | |
| 6,583,408 | B2 | 6/2003 | Smith et al. | |
| 6,744,042 | B2 | 6/2004 | Zajfman et al. | |
| 6,753,523 | B1 | 6/2004 | Whitehouse | |
| 6,888,130 | B1 | 5/2005 | Gonin | |
| 7,314,912 | B1 | 1/2008 | Hallek et al. | |
| 7,829,842 | B2 | 11/2010 | Makarov | |
| 8,294,085 | B2 | 10/2012 | Ding | |
| 8,395,112 | B1 | 3/2013 | Bier | |
| 8,409,870 | B2 | 4/2013 | Van Wujickhuijse | |
| 9,095,793 | B2 | 8/2015 | Flagan | |
| 10,056,244 | B1 | 8/2018 | Quarmby et al. | |
| 2003/0155502 | A1 | 8/2003 | Grosshans et al. | |
| 2004/0169137 | A1 | 9/2004 | Westphall et al. | |
| 2005/0236375 | A1 | 10/2005 | Gefter et al. | |
| 2007/0254352 | A1 | 11/2007 | Schaffer et al. | |
| 2009/0020694 | A1 | 1/2009 | Flory | |
| 2009/0078866 | A1* | 3/2009 | Li ..... | H01J 49/425 250/297 |
| 2010/0084549 | A1 | 4/2010 | Ermakov et al. | |
| 2010/0084552 | A1 | 4/2010 | Kawana | |
| 2010/0090102 | A1 | 4/2010 | Rather et al. | |
| 2010/0227310 | A1 | 9/2010 | Manalis et al. | |
| 2010/0234837 | A1 | 9/2010 | Alfano | |
| 2010/0314538 | A1 | 12/2010 | Makarov et al. | |
| 2010/0320377 | A1 | 12/2010 | Cotter | |
| 2011/0095175 | A1 | 4/2011 | Bateman | |
| 2011/0240845 | A1 | 10/2011 | Ding | |
| 2012/0112056 | A1 | 5/2012 | Brucker et al. | |
| 2012/0282641 | A1 | 11/2012 | Reilly et al. | |
| 2013/0175440 | A1 | 7/2013 | Perelman et al. | |
| 2013/0124099 | A1 | 8/2013 | Ecker | |
| 2013/0200261 | A1 | 8/2013 | Mizutani et al. | |
| 2013/0234017 | A1 | 9/2013 | Kaltashov et al. | |
| 2013/0327934 | A1 | 12/2013 | Makarov et al. | |
| 2014/0197333 | A1 | 7/2014 | Jolliffe et al. | |
| 2014/0346344 | A1 | 11/2014 | Chen | |
| 2015/0008316 | A1 | 1/2015 | Guna | |
| 2015/0021472 | A1 | 1/2015 | Makarov | |
| 2015/0325425 | A1 | 11/2015 | Makarov | |
| 2015/0331000 | A1 | 11/2015 | Collier et al. | |
| 2016/0005580 | A1 | 1/2016 | Grinfeld et al. | |
| 2016/0035556 | A1 | 2/2016 | Berkout et al. | |
| 2016/0181084 | A1 | 6/2016 | Smith | |
| 2016/0336165 | A1 | 11/2016 | Guna | |
| 2017/0040152 | A1 | 2/2017 | Makarov | |
| 2017/0307565 | A1 | 10/2017 | Clemmer et al. | |
| 2017/0372883 | A1 | 12/2017 | Verenchikov | |
| 2020/0243317 | A1 | 7/2020 | Lopez-Hilfiker et al. | |
| 2020/0357626 | A1 | 11/2020 | Jarrold et al. | |

FOREIGN PATENT DOCUMENTS

| | | | |
|---|---|---|---|
| WO | 2000028004 | A1 | 5/2000 |
| WO | 2000028061 | A1 | 5/2000 |
| WO | 2001092551 | A2 | 5/2001 |
| WO | 003042704 | A1 | 5/2003 |
| WO | 2006130474 | A2 | 12/2006 |
| WO | 2010135830 | A1 | 12/2010 |
| WO | 20120083031 | A1 | 6/2012 |
| WO | 012145037 | A1 | 10/2012 |
| WO | 016073850 | A1 | 5/2016 |
| WO | 2017162779 | A1 | 9/2017 |
| WO | 20170190031 | A1 | 11/2017 |
| WO | 2019118242 | A1 | 6/2019 |
| WO | 20190140233 | A1 | 7/2019 |
| WO | 2019231854 | A1 | 12/2019 |

OTHER PUBLICATIONS

PCT International Search Report and Written Opinion completed by the ISA/US on Jun. 19, 2017 and issued in connection with PCT/US2017/030163.

PCT International Search Report and Written Opinion completed by the ISA/EP on Feb. 14, 2019 and issued in connection with PCT/US2018/051944.

PCT International Search Report and Written Opinion completed by the ISA/EP on Apr. 18, 2019 and issued in connection with PCT/US2019/013251.

PCT International Search Report and Written Opinion completed by the ISA/EP on Apr. 16, 2019 and issued in connection with PCT/US2019/013274.

PCT International Search Report and Written Opinion completed by the ISA/EP on Mar. 27, 2019 and issued in connection with PCT/US2019/013277.

PCT International Search Report and Written Opinion completed by the ISA/EP on Mar. 28, 2019 and issued in connection with PCT/US2019/013280.

PCT International Search Report and Written Opinion completed by the ISA/EP on Mar. 27, 2019 and issued in connection with PCT/US2019/013283.

PCT International Search Report and Written Opinion completed by the ISA/EP on Mar. 29, 2019 and issued in connection with PCT/US2019/013284.

PCT International Search Report and Written Opinion completed by the ISA/EP on Sep. 9, 2019 and issued in connection with PCT/US2019/035379.

PCT International Search Report and Written Opinion completed by the ISA/EP on Aug. 27, 2019 and issued in connection with PCT/US2019/035381.

PCT International Search Report and Written Opinion completed by the ISA/EP on Jul. 14, 2020 and issued in connection with PCT/US2020/029287.

PCT International Search Report and Written Opinion completed by the ISA/US on Nov. 23, 2020 and issued in connection with PCT/US2020/052009.

PCT International Search Report and Written Opinion completed by the ISA/US on Jan. 24, 2021 and issued in connection with PCT/US2020/054975.

Anthony, Staci N. "MS /MS instrumentation for megadalton-sized ions", 2016, XP055619426, ISBN: 978-1-369-02558-3 Retrieved from the Internet: URL:https://search.proquest.com/docview/1830450391?accountid=29404.

Anthony, et al., A simple electrospray interface based on a DC ion carpet, Int. J. Mass Spectrom. 371, 1-7 (2014).

Bantel-Schall, U., et al., "Human Adena-Associated Virus Type 5 Is Only Distantly Related to Other Known Primate Helper-Dependent Parvoviruses", Journal of Virology, vol. 73, pp. 939-947 (Feb. 1999).

Beuhler, et al., Threshold studies of secondary electron emission induced by macro ion impact on solid surfaces. Nucl. Instrum. Methods. 170, 309-315 (1980).

Beuhler, et al., A study of the formation of high molecular weight water cluster ions (m/e < 59000) in expansion of ionized gas mixtures, J. Chem. Phys. 77, 2549-2557 (1982).

Botamanenko, Daniel, et al., "Ion-Ion Interactions in Charge Detection Mass Spectrometry", J Am Soc Mass Spectrom. Dec. 2019 ; 30(12): 2741-2749. doi:10.1007/s13361-019-02343-y.

(56) References Cited

OTHER PUBLICATIONS

Brancia, et al., Digital asymmetric waveform isolation {DAWI) in a digital linear ion trap. J_ Am. Soc_ Mass Spectrom. 1. 1530-1533 (2010).
Brown, C., et al. "Chimeric Parvovirus B19 Capsids for the Presentation of Foreign Epitope",; Virology 198, pp. J77-488 (1994).
Burnham, et al. "Analytical Ultracentrifugation as an Approach to Characterize Recombinant Adena-Associated Viral Vectors", Human Gene Therapy Methods, vol. 26, No. 6; pp. 228-242, Oct. 15, 2015.
Chao, Hengjun, et al. "Several Log Increase in Therapeutic Transgene Delivery by Distinct Adena-Associated Viral Serotype Vectors" Molecular Therapy vol. 2, No. 6, pp. 619-623 (Dec. 2000).
Chiorini, John A., et al. "Cloning of Adeno-Associated Virus Type 4 (MV4) and Generation of Recombinant MV4 Particles",Journal of Virology, vol. 71, pp. 6823-6833 (Sep. 1997).
Chiorini, John A., "Cloning and Characterization of Adeno-Associated Virus Type 5", Journal of Virology, vol. 73, DP-1309-1319 (Feb. 1999).
Chernushevich, et al., Collisional cooling of large ions in electrospray mass spectrometry. Anal. Chem 76. H54-1760 (2004).
Cleves, Ann E., "Protein transport: The nonclassical ins and outs", Current Biology, vol. 7, No. 5, pp. 318-320 (1997).
Contino, Nathan Colby, "Ion trap charge detection mass spectrometry: Lowering limits of detection and improving signal to noise", ISBN: 9781303535048, Jul. 30, 2013 (Jul. 30, 2013).
Ding, et al., A simulation study of the digital ion trap mass spectrometer. Int. J. Mass Spectrom. 221, 117-138 (2002).
Ding, et al., A digital ion trap mass spectrometer coupled with atmospheric pressure ion sources. J_ Mass Spectrom. 69, 471-484(2004).
Douglas J_ Linear quadrupoles in mass spectrometry. Mass Spectrom. Rev. 28, 937-960 (2009).
Doussineau, Tristan, et al. "Infrared multiphoton dissociation tandem charge detection-mass spectrometry of single megadalton electrosprayed ions", Review of Scientific Instruments, AIP, Melville, NY, US, vol. 82, No. 8, Aug. 1, 2011, pp. 84104-84104.
Draper, Benjamin E., et al., "Real-Time Analysis and Signal Optimization for Charge Detection Mass Spectrometry", J. Am. Soc. Mass Spectrom. (2019) 30:898Y904.
Draper, Benjamin E., et al., "The FUNPET—a New Hybrid Ion Funnel-Ion Carpet Atmospheric Pressure Interface for the Simultaneous Transmission of a Broad Mass Range," J. Am. Soc. Mass Spectrom. (2018) 29:2160-2172.
Elliott, Andrew G., et al. "Simultaneous Measurements of Mass and Collisional Cross-Section of Single Ions with charge Detection Mass Spectrometry", Analytical Chemistry, vol. 89, No. 14, Jun. 16, 2017, pp. 7701-7708.
Elliott, Andrew G., et al. "Single Particle Analyzer of Mass: A Charge Detection Mass Spectrometer with a Multi-Detector Electrostatic Ion Trap", International Journal of Mass Spectrometry, Elsevier Science Publishers, Amsterdam, NL, vol. 414, Jan. 15, 2017, pp. 45-55.
Elliott, Andrew G., et al. "Effects of Individual Ion Energies on Charge Measurements in Fourier Transform Charge Detection Mass Spectrometry (FT-CDMS)", Journal of the American Society for Mass Spectrometry., Nov. 14, 2018 (Nov. 14, 2018).
Emerson, S., et al. "Hepatitis E Virus", Virology, vol. 2, Chapter 70; (4th ed., Lippincott-Raven Publishers). Fields, Bernard, et al. "Darvoviridae: The Viruses and Their Replication" Virology, vol. 2, Chapter 69, pp. 2327-2359; 4th ed., Lippincott-Raven Publishers).
Fields, Bernard, et al. "Parvoviridae: The Viruses and Their Replication" Virology, vol. 2, Chapter 69, pp. 2327-2359; 4th ed., Lippincott-Raven Publishers).
Fuerstenau, et al., "Mass Spectrometry of an Intact Virus", Agnew. Chem. 2001, 559-562.
Gao, Guangping, et al. "Clades of Adeno-Associated Viruses Are Widely Disseminated in Human Tissues", vol. 78, pp. 6381-6388 (Jun. 2004).
Gao, Guangping, et al. "Novel Adeno-Associated Viruses from Rhesus Monkeys as Vectors for Human GeneTherap",.; National Academy of Sciences, vol. 99, No. 18, pp. 11854-11859 (Sep. 3, 2002).
Gorman, Linda, et al. "Stable Alteration of Pre-mRNA Splicing Patterns by Modified U7 Small Nuclear RNAs", National Academy of Sciences, vol. 95, No. 9, pp. 4929-4934 (Apr. 28, 1998).
Grifman, M., et al. "Incorporation of Tumor-Targeting Peptides into Recombinant Adeno-associated Virus Capsids", Molecular Therapy, vol. 3, No. 6, pp. 964-975 (Jun. 2001).
Draper, Benjamin E., "The FUNPET—a New Hybrid Ion Funnel-Ion Carpet Atmospheric Pressure Interface for the Simultaneous Transmission of a Broad Mass Range", Journal of the American Society of Mass Spectrometry 29, 2160-2172, Aug. 15, 2018.
El-Baba, Tarick J., et al., "Melting Proteins Confined in Nanodroplets With 10.6 um Light Provided Clues About Early Steps of Denaturation", Chemical Communications, vol. 54, No. 26, 3270-3273, 2018.
Heller, Manfred, et al. "Mass Spectrometry-Based Analytical Tools for the Molecular Protein Characterization of Human Plasma Lipoproteins", Proteomics 2005, 5, 2619-2630.
Hutchins, Patrick M., et al. "Quantification of HDL Particle Concentration by Calibrated Ion Mobility Analysis", Clinical Chemistry 60:11, 1393-1401, 2014.
Kukreja, Alexander A., et al. "Structurally Similar Woodchuck and Human Hepadnavirus Core Proteins Having Distinctly Different Temperature Dependencies of Assembly" Journal of Virology, vol. 68, No. 24, 14105-14115, Sep. 24, 2014.
Todd, Aaron R., et al. "Implementation of a Charge-Sensitive Amplifier without a Feedback Resistor for Charge Detection Mass Spectrometry Reduces Noise and Enables Detection of Individual Ions Canying a Single Charge", J. Am. Soc. Mass Spectrom. 2020, 31, 146-154.
Bioconjugate Techniques; Hermanson; .Academic Press, 1st Edition (1996),. (book reference, to be made available upon request).
PCT International Search Report and Written Opinion completed by the ISA/EP on Mar. 8, 2021 and issued in connection with PCT/US2020/065300.
PCT International Search Report and Written Opinion completed by the ISA/EP on Mar. 8, 2021 and issued in connection with PCT/US2020/065301.
PCT International Search Report and Written Opinion completed by the ISA/US on Apr. 5, 2021 and issued in connection with PCT/US2021/016435.
PCT International Search Report and Written Opinion completed by the ISA/US on Mar. 18, 2021 and issued in connection with PCT/US2021/016325.
PCT International Search Report and Written Opinion completed by the ISA/EP on Sep. 9, 2019 and issued in connection with PCT/US2020/035379.
PCT International Search Report and Written Opinion completed by the ISA/EP on Apr. 2, 2019 and issued in connection with PCT/US2019/013279.
PCT International Search Report and Written Opinion completed by the ISA/EP on Mar. 19, 2019 and issued in connection with PCT/US2019/013281.
Hauck, B., et al. "Characterization of Tissue Tropism Determinants of Adeno-Associated Virus Type 1", Journal of Virology, vol. 77, No. 4, pp. 2768-2774 (Feb. 2003).
Heller, et al., "Mass spectrometry-based analytical tools for the molecular protein characterization of human plasma lipoproteins," Proteomics 2005, 5, 2619—2630.
Hogan, Joanna, et al. "Optimized Electrostatic Linear Ion Trap for Charge Detection Mass Spectrometry", Jul. 9, 2018 (Jul. 9, 2018), vol. 29, No. 10, p. 2086-2095.
Keifer, David Z., "Single-Molecule Mass Spectrometry", Mass Spectrometry Reviews, vol. 36 pp. 715-733 (2017).
Keifer, David Z., et al. "Charge Detection Mass Spectrometry with Almost Perfect Charge Accuracy", Analytical Chemistry, vol. 87, No. 20, Oct. 20, 2015, pp. 10330-10337.
Kelly, Ryan T., et al. "The ion funnel: Theory, implementations, and applications", Mass Spectrometry Reviews., vol. 29, Apr. 23, 2009, pp. 294-312.

(56) References Cited

OTHER PUBLICATIONS

Kim et al., A multicapillary inlet jet disruption electrodynamic ion funnel interface for improved sensitivity using tmospheric pressure ion sources. Anal. Chem. 73, 4162-4170 (2001).
Koizumi et al., A novel phase-coherent programmable clock for high-precision arbitrary waveform generation applied to digital ion trap mass spectrometry_ Int. J_ Mass Spectrom_ 292, 23-31 (2010).
Konenkov et al., Matrix methods for the calculation of stability diagrams in quadrupole mass spectrometry. J. Amer. Soc. Mass Spec. 13, 597-613 (2002).
Landais et al., Varying the radio frequency: A new scanning mode for quadrupole analyzers. Rapid Commun. Mass Spectrom. 12, 302-306 (1998).
Marmet et al., A frequency-swept quadrupole mass filler. Int. J_ Mass Spectrom. Ion Proc. 42, 3-10 (1982).
Martin, Stability of doubly charged alkali halide clusters. J_ Chem. Phys. 76, 5467-5469 (1982).
Miyamura, K., et al. "Parvovirus Particles as Platforms for Protein Presentation", National Academy of Sciences, vol. 1,No. 18,pp. 8507-8511 (Aug. 30, 1994).
Mori, Seiichiro, Mori, et al. "Two novel adeno-associated viruses from cynomolgus monkey: pseudotyping characterization of capsid protein", Virology 330, pp. 375-383 (2004).
Muzyczka, N., "Use of Adeno-Associated Virus as a General Transduction Vector for Mammalian Cells", Current Topics n Microbiology and Immunology, vol. 158, pp. 97-129 (1992).
Muramatsu, S., et al. "Nucleotide Sequencing and Generation of an Infectious Clone of Adeno-Associated Virus 3", Virology vol. 221; Article No. 0367; pp. 208-217 (1996).
Nie et al., Frequency scan of a quadrupole mass analyzer in the third stability region for protein analysis. J. Chin. Chem_ Soc., 53, 47-52 (2006).
Padron, Eric, et al. "Structure of Adeno-Associated Virus Type 4", Journal of Virology, vol. 79, No. 8, pp. 5047-5058 Apr. 2005).
Paul, et al., Das elektrische massenfiller, Z. Phys. 140, 262-273 (1955).
Paul et al., Das elektrische massenfilter als massenspektromeler und isotopenlrenner. Z. Phys. 152, 143-182 (1958).
Pierson, Elizabeth E., et al., "Detection of 1-15 Late Intermediates in Virus Capsid Assembly by Charge Detection Mass Spectrometry", Journal of the American Chemical Society, vol. 136, No. 9, Feb. 19, 2014, 3536-3541.
Pierson, Elizabeth E., et al., Charge Detection Mass Spectrometry for Single Ions with an Uncertainty in the Charge Measurement of 0.65 e; Elizabeth E_ Pierson et al.; Journal American Society for Mass Spectrometry, vol. 26, pp. 1213-1220 (2015).
Pierson, Elizabeth E., et al. "Charge Detection Mass Spectrometry Identifies Preferred Non-icosahedral Polymorphs in the Self-Assembly of Woodchuck Hepatitis Virus Capsids", Jour. of Molecular Biology, vol. 428, Issue 2, pp. 292-300. Jan. 29, 2016.
Puttaraju, M., et al. "Spliceosome-mediated RNA trans-splicing as a tool for gene therapy", Nature Biotechnology, vol. 17, pp. 246-252 (Mar. 1999).
Richards et al., A new operating mode for the quadrupole mass filler. Int. J. Mass Spectrom. Ion Phys. 12, 317-339 1973).
Richards et al., Waveform parameter tolerances for the quadrupole mass filler with rectangular excitation. Int. J. Mass Spectrom. Ion Phys_ 15, 417-428 (1974).
Schlunegger et al., Frequency scan for the analysis of high mass ions generated by matrix-assisted laser esorption/ionization in a Paul trap_ Rapid Commun. Mass Spectrom. 13, 1792-1796 (1999).
Shade, Rosemary, et al. "Nucleotide Sequence and Genome Organization of Human Parvovirus B19 Isolated from the Serum of a Child during plastic Crisis", Journal of Virology, vol. 58, No. 3, pp. 921-936 (Jun. 1986).
Sharp, Phillip A., et al. "RNA Interference", American Association for the Advancement of Science; Science, New Series, vol. 287, No. 5462, pp. 2431-2433 (Mar. 31, 2000).
Shi, Z., et al. "Insertional Mutagenesis at Positions 520 and 584 of Adena-Associated Virus Type 2 (MV2) Capsid Gene and Generation of MV2 Vectors with Eliminated Heparin-Binding Ability and Introduced Novel Tropism", Human Gene Therapy, vol. 17, pp. 353-361 (Mar. 2006).
Shinholt, Review of Scientific Instruments. 85, 113109 (2014); doi: 10.1063/1.4900627.
Sobott et al., A tandem mass spectrometer for improved transmission and analysis of large macromolecular Assemblies. Anal. Chem. 74, 1402-1407 (2002).
Sonalikar, S., et al., "Numerical analysis of segmented-electrode Orbitraps", In International Journal of Mass Spectrometry, Elsevier Science Publishers, Amsterdam, NL, vol. 395, Dec. 17, 2015 (Dec. 17, 2015), pp. 36-48.
Srivastava, Arun, et al., "Nucleotide Sequence and Organization of the Adena-Associated Virus 2 Genome", Journal of Virology, vol. 45, No. 2, pp. 555-564 (Feb. 1983).
Syed, et al., Quadrupole mass filler: Design and performance for operation in stability zone 3. J. Am. Soc. Mass Spectrom 24, 1493-1500 (2013).
Tsao, Jun, et al., "The Three-Dimensional Structure of Canine Parvovirus and Its Functional Implications", American Association for the Advancement of Science, Science, New Series, vol. 251, No. 5000, pp. 1456-1464 (Mar. 22, 991).
Walters, Robert W., "Structure of Adeno-Associated Virus Serotype 5", Journal of Virology, vol. 78, No. 7, pp. B361-3371 (Apr. 2004).
Uetrecht et al., "Stability and Shape of Hepatitis B Virus Capsids In Vacuo", Angew. Chem. Int. Ed. 2008, 47, 6247-6251.
Uetrecht et al., "High-resolution mass spectrometry of viral assemblies: Molecular composition and stability of dimorphic hepatitis B virus capsids", PNAS 2008, vol. 105, 9216-9920.
Wang, Lei, et al., "Expanding the Genetic Code", Annual Review of Biophysics and Biomolecular Structure, vol. 35, pp. 25-249 (2006).
Winger, et al., Observation and implications of high mass-lo-charge ratio ions from electrospray ionization mass spectrometry, J_ Am_ Soc_ Mass Spectrom. 4, 536-545 (1993).
Xiao, Weidong, et al., "Gene Therapy Vectors Based on Adena-Associated Virus Type 1", Journal of Virology, vol. 73, No. 5, pp. 3994-4003 (May 1999).
Xie, Qing, et al., "Canine Parvovirus Capsid Structure, Analyzed at 2.9 A Resolution", Journal of Molecular Biology, vol. 64, pp. 497-520 (1996).
Xie, Qing, et al., "The atomic structure of adeno-associated virus (MV-2), a vector for human gene therapy", PNAS, vol. 99, No. 16, pp. 10405-10410 (Aug. 6, 2002).
Xiong, et al., The development of charge detection-quadrupole ion trap mass spectrometry driven by rectangular and triangularwaves, Analyst 137, 1199-1204 (2012).
Yang, et al., Development of a palm portable mass spectrometer. J. Amer. Soc. Mass Spec. 19, 1442-1448 (2008).
Yost, et al., Selected ion fragmentation with a tandem quadrupole mass spectrometer. J. Am. Chem. Soc. 100, 274-2275 (1978).
Supplemental European Search Report for European Patent Application No. 17790559.3 dated Nov. 12, 2019 (11 pages).
PCT International Search Report and Written Opinion completed by the ISA/EP on Jul. 24, 2019 and issued in connection with PCT/US2019/013278.
PCT International Search Report and Written Opinion completed by the ISA/EP on Jul. 26, 2019 and issued in connection with PCT/US2019/013285.
Grinfeld, Dmitry, et al., "Space-Charge Effects in An Electrostatic Multi-reflection Ion Trap", European Journal of Mass Spectrometry, vol. 20, No. 2, Apr. 1, 2014 (Apr. 1, 2014), pp. 131-142.
Hrishikesh, S., et al., "Numerical analysis of segmented-electrode Orbitraps", International Journal of Mass Spectrometry, Elsevier Science Publishers, Amsterdam, NL, vol. 395, Dec. 17, 2015 (Dec. 17, 2015), pp. 36-48.
Keifer, David, et al., "Charge detection mass spectrometry: weighing heavier things", Analyst, vol. 142, No. 10, Jan. 1, 2017 (Jan. 1, 2017), pp. 1654-1671.
Makarov, A., "Electrostatic Axially Harmonic Orbital Trapping: A High-Performance Technique of Mass Analysis", Analytical Chemistry, vol. 72, No. 6, Mar. 1, 2000 (Mar. 1, 2000), pp. 1156-1162.

(56) References Cited

OTHER PUBLICATIONS

Charge Detection Mass Spectrometry of Bacteriophage P22 Procapsid Distributions Above 20MDa, David Keifer et al, Rapid Communications in Mass Spectrometry, vol. 28, No. 5.
Charge Detection Mass Spectrometry: Instrumentation & Applications to Viruses, Elizabeth Pierson, Proquest Dissertations and Theses; Thesis (Ph.D.) vol. 76-09(E), Section: B. 168.
Defining the Stoichiometry and Cargo Load of Viral and Bacterial Nanoparticles by Orbitrap Mass Spectrometry, Snijder, J. et al, J. Am. Chem. Soc. 2014, 136, 7295-7299.
Analysis of a Common Cold Virus and Its Subviral Particles by Gas-Phase Electrophoretic Mobility Molecular Analysis and Native Mass Spectrometry, Weiss Vu et al., Anal Chem. 2015.
Product-Related Impurities in Clinical-Grade Recombinant AAV Vectors: Characterization and Risk Assessment, J Fraser Wright, Biomedicines 2014, 2, 80-97.
European Office Action dated Sep. 2, 2021 in application 19 707 901.5.

* cited by examiner

ORBITRAP FOR SINGLE PARTICLE MASS SPECTROMETRY

CROSS-REFERENCE TO RELATED APPLICATIONS

This application is a U.S. national stage entry of PCT Application No. PCT/US2019/013278, filed Jan. 11, 2019, which claims the benefit of and priority to U.S. Provisional Patent Application Ser. No. 62/769,952, filed Nov. 20, 2018, the disclosures of which are incorporated herein by reference in their entireties.

GOVERNMENT RIGHTS

This invention was made with government support under CHE1531823 awarded by the National Science Foundation. The United States Government has certain rights in the invention.

TECHNICAL FIELD

The present disclosure relates generally to mass spectrometry instruments, and more specifically to single particle mass spectrometry employing an orbitrap to measure ion m/z and charge.

BACKGROUND

Mass Spectrometry provides for the identification of chemical components of a substance by separating gaseous ions of the substance according to ion mass and charge. Various instruments and techniques have been developed for determining the masses of such separated ions, and the choice of such instruments and/or techniques generally will typically depend on the mass range of the particles of interest. For example, in the analysis of "lighter" particles in the sub-megadalton range, e.g., less than 10,000 Da, conventional mass spectrometers may typically be used, some examples of which may include time-of-flight (TOF) mass spectrometers, reflectron mass spectrometers, Fourier transform ion cyclotron resonance (FTICR) mass spectrometers, quadrupole mass spectrometers, triple quadrupole mass spectrometers, magnetic sector mass spectrometers, and the like.

In the analysis of "heavier" particles in the megadalton range, e.g., 10,000 Da and greater, conventional mass spectrometers of the type just described are not well-suited due to well-known, fundamental limitations of such instruments. In the riegadalton range, one alternate mass spectrometry technique, known as charge detection mass spectrometry (CDMS), is generally more suitable. In CDMS, ion mass is determined for each ion individually as a function of measured ion mass-to-charge ratio, typically referred to as "mlz," and measured ion charge. Some such CDMS instruments employ an electrostatic linear ion trap (FLIT) detector in which ions are made to oscillate back and forth through a charge detection cylinder. Multiple passes of ions through such a charge detection cylinder provides for multiple measurements for each ion, and such multiple measurements are then processed to determine ion mass and charge.

Uncertainty in ion charge measurements in an FLIT can be made to be negligible, or nearly so, through appropriate design and operation of the detector. However, uncertainty in ion mass-to-charge ratio measurements remains undesirably high with current FLIT designs. In this regard, the mass-to-charge ratio resolving power obtainable with an orbitrap is generally understood to far surpass that which can be obtained in an FLIT used for CDMS, although poor charge measurement accuracy plagues current orbitrap designs.

SUMMARY

The present disclosure may comprise one or more of the features recited in the attached claims, and/or one or more of the following features and combinations thereof. In one aspect, an orbitrap may comprise an elongated inner electrode defining a longitudinal axis centrally therethrough and a transverse plane centrally therethrough normal to the longitudinal axis, the inner electrode having a curved outer surface defining a maximum radius $R_1$ about the longitudinal axis through which the transverse plane passes, an elongated outer electrode having a curved inner surface defining a maximum radius $R_2$ about the longitudinal axis through which the transverse plane passes, wherein $R_2>R_1$ such that a cavity is defined between the inner surface of the outer electrode and the outer surface of the inner electrode, and means for establishing an electric field configured to trap an ion in the cavity and cause the trapped ion to rotate about, and oscillate axially along, the inner electrode, wherein the rotating and oscillating ion induces a charge on at least one of the inner and outer electrode, wherein $R_1$ and $R_2$ are selected to have values that maximize a percentage of the induced charge as a function of $\ln(R_2/R_1)$.

In another aspect, an orbitrap may comprise an elongated inner electrode defining a longitudinal axis centrally therethrough and a transverse plane centrally therethrough normal to the longitudinal axis, an elongated outer electrode defining a curved inner surface having a maximum radius $R_2$, about the longitudinal axis, through which the transverse plane passes, wherein a cavity is defined between an outer surface of the inner electrode and the inner surface of the outer electrode, means for establishing an electric field configured to trap an ion in the cavity and to cause the trapped ion to rotate about, and oscillate axially along, the inner electrode, wherein the rotating and oscillating ion induces a charge on at least one of the inner and outer electrode, and a characteristic radius $R_m$, about the longitudinal axis, corresponding to a radial distance from the longitudinal axis at which the established electric field no longer attracts ions toward the longitudinal axis, wherein values of $R_m$ and $R_2$ are selected to maximize a percentage of the induced charge as a function of $(R_m/R_2)$.

In yet another aspect, an orbitrap may comprise an elongated inner electrode defining a longitudinal axis centrally therethrough and a transverse plane centrally therethrough normal to the longitudinal axis, the inner electrode defining two axially spaced apart inner electrode halves with the transverse plane passing therebetween, an elongated outer electrode defining two axially spaced apart outer electrode halves with the transverse plane passing therebetween, a cavity defined radially about the longitudinal axis and axially along the inner and outer electrodes between an outer surface of the inner electrode and an inner surface of the outer electrode, means for establishing an electric field configured to trap an ion in the cavity and to cause the trapped ion to rotate about, and oscillate axially along, the inner electrode, wherein the rotating and oscillating ion induces charges on the inner and outer electrode halves, and charge detection circuitry configured to detect charges induced by the rotating and oscillating ion on the inner electrode halves and on the outer electrode halves, and to combine the detected charges for each oscillation to produce a measured ion charge signal.

In still another aspect, a system for separating ions may comprise an ion source configured to generate ions from a sample, at least one ion separation instrument configured to separate the generated ions as a function of at least one molecular characteristic, and the orbitrap as described above in any one or combination of the above aspects, further comprising an opening configured to allow passage of an one ion exiting the at least one ion separation instrument into the cavity for rotation about, and oscillate axially along, the inner electrode.

In a further aspect, a system for separating ions may comprise an ion source configured to generate ions from a sample, a first mass spectrometer configured to separate the generated ions as a function of mass-to-charge ratio, an ion dissociation stage positioned to receive ions exiting the first mass spectrometer and configured to dissociate ions exiting the first mass spectrometer, a second mass spectrometer configured to separate dissociated ions exiting the ion dissociation stage as a function of mass-to-charge ratio, and a charge detection mass spectrometer (CDMS), including the orbitrap as described above in any one or combination of the above aspects, coupled in parallel with and to the ion dissociation stage such that the CDMS can receive ions exiting either of the first mass spectrometer and the ion dissociation stage, wherein masses of precursor ions exiting the first mass spectrometer are measured using CDMS, mass-to-charge ratios of dissociated ions of precursor ions having mass values below a threshold mass are measured using the second mass spectrometer, and mass-to-charge ratios and charge values of dissociated ions of precursor ions having mass values at or above the threshold mass are measured using the CDMS.

DESCRIPTION OF THE ILLUSTRATIVE EMBODIMENTS

For the purposes of promoting an understanding of the principles of this disclosure, reference will now be made to a number of illustrative embodiments shown in the attached drawings and specific language will be used to describe the same.

This disclosure relates to apparatuses and techniques for carrying out single particle mass spectral analysis of substances which may typically, although not exclusively, include particles having particle masses in the megadalton (MDa) range. As will be described in detail below, the apparatuses and techniques include as one component thereof at least one embodiment of a so-called "orbitrap." For purposes of this disclosure, an "orbitrap" is defined as an electrostatic ion trap which employs orbital trapping in an electrostatic field and in which particles oscillate both radially about and along a central longitudinal axis of an elongated center or "inner" electrode.

Figure 1:
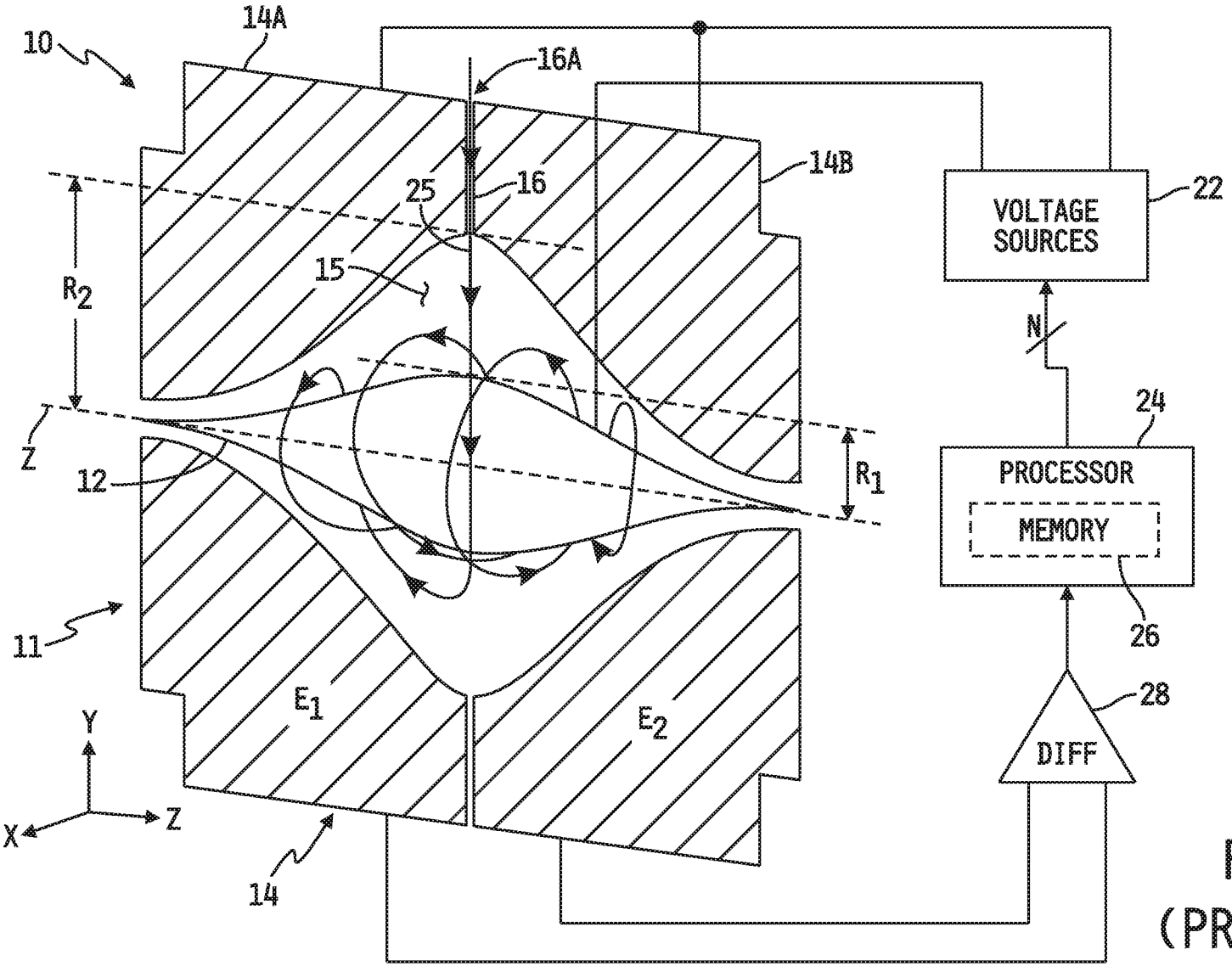
FIG. 1 (PRIOR ART)
FIG. 1 is a simplified, partial cutaway diagram of a conventional orbitrap system including conventional orbitrap with conventional control and measurement components coupled thereto.

Referring now to FIG. 1, a conventional orbitrap-based particle detection system 10 of a mass spectrometer or mass spectral analysis system is shown. The system 10 illustratively includes a conventional orbitrap 11 operatively coupled to conventional control and measurement circuitry. The orbitrap 11 includes an elongated, unitary, spindle-like inner electrode 12 surrounded by a split, outer barrel-like electrode 14. A Z-axis of the orbitrap 11 extends centrally and axially through the inner electrode 12. The inner electrode 12 is "spindle-like" in the sense that it is shaped as a conventional spindle with a generally circular transverse cross-section having a maximum outer radius $R_1$ at the longitudinal center which tapers downwardly in the axial direction to a minimum radius at or adjacent to each end. The maximum outer radius $R_1$ is measured radially from the Z-axis.

The outer barrel-like electrode 14 is split between two axial halves 14A and 14B with a space 16 between the two halves generally aligned with the axial center of the inner electrode 12. A cavity 15 is formed between the inner surfaces of the outer electrodes 14A and 14B and the outer surface of the inner electrode 12 and, like the outer surface of the inner electrode 12, inner surfaces of the two axial halves 14A and 14B of the outer electrode 14 are symmetrical such that the shape of the cavity 15 between the outer electrode half 14A and the inner electrode 12 is the same as the shape of the cavity between the outer electrode half 14B, i.e., on each side of the space 16. Opposite the outer surface of the inner electrode 12, the inner surface of the outer electrode 14 has a maximum inner radius $R_2$ at the longitudinal center, i.e., at the opposing edges of the space 16, which tapers downwardly in the axial direction to a minimum radius at or adjacent to each end. Like the maximum outer radius $R_1$ of the inner electrode 12, the maximum inner radius $R_2$ of the outer electrode 14 is measured radially from the Z-axis. As illustrated by example in FIG. 1, the shapes, i.e., the curved contours, of the outer surface of the inner electrode 12 and of the inner surface of the outer electrode 14 of the conventional orbitrap 11 are generally different from one another with the inner surface of the outer electrode generally having a greater slope toward its center such that the distance between $R_1$ and $R_2$, i.e., at the axial centers of the electrodes 12, 14, is greater than the distance between the outer surface of the inner electrode 12 and the inner surface of the outer electrode 14 as such surfaces taper away from their axial centers.

Each of the inner electrode 12 and the outer electrode 14 are electrically coupled to one or more voltage sources 22 operable to selectively apply control voltages to each. In some implementations, the one or more voltage sources 22 are electrically connected to a processor 24 via N signal paths, where N may be any positive integer. In such implementations, a memory 26 has instructions stored therein which, when executed by the processor 24, cause the processor 24 to control the one or more voltage sources 22 to selectively apply control or operating voltages to each of the inner and outer electrodes 12, 14 respectively.

Each of the outer electrodes 14A and 14B are electrically coupled to respective inputs of a conventional differential amplifier 28, and the output of the differential amplifier 28 is electrically coupled to the processor 24. The memory 26 has instructions stored therein which, when executed by the processor 24, cause the processor 24 to process the output signal produced by the differential amplifier to determine mass-to-charge information of particles trapped within the orbitrap 11.

In operation, the one or more voltage sources 22 are first controlled to apply suitable potentials to the inner and outer electrodes 12, 14 to create a corresponding electric field oriented to draw charged particles, i.e., ions, into the cavity 15 via the external opening 16A of the space 16. The one or more voltage sources 22 are then controlled to apply suitable potentials to the inner and outer electrodes 12, 14 to create an electrostatic field within the cavity 15 which traps the charged particles therein. This electrostatic field between the inner and outer electrodes 12, 14 has a potential distribution U(r, z) which is defined by the following equation:

$$U(r,z)=k/2(z^2)-(r^2-R_1^2)/2(k/2\times R_m^2\times\ln[r/R_1])-Ur \quad (1),$$

where r and z are cylindrical coordinates (with z=0 being the plane of symmetry of the field), k is the field curvature, $R_1$ is the maximum radius of the inner electrode 12 (as described above) and Ur is the potential applied to the inner electrode 12. $R_m$ is a so-called "characteristic radius," which is the radial distance from the Z-axis at which the electrostatic field no longer attracts ions toward the Z-axis, and it is generally understood that for stable radial oscillations of ions during electrostatic trapping the relationship $R_m/R_2>2^{1/2}$ must typically be satisfied. This electrostatic field is the sum of a quadrupole field of the ion trap 11 and a logarithmic field of a cylindrical capacitor, and is accordingly generally referred to as a quadro-logrithmic field.

Trajectories 25 of ions trapped within the cavity 15 of the orbitrap 11 under the influence of the quadro-logrithmic field are a combination of orbital motion about the inner electrode 12 and oscillations along the inner electrode 12 in the direction of the Z-axis, as illustrated by example in FIG. 1. Ion mass-to-charge ratio is derived from the frequency of harmonic oscillations in the axial direction of the quadro-logrithmic field, i.e., in the direction of the Z-axis, because, unlike the frequency of orbital rotation of ions about the inner electrode 12, the frequency of such axial or Z-plane ion oscillation is independent of ion energy. Such axial ion oscillations induce image charges on each of the outer electrode halves 14A, 14B, and the frequency of the resulting differential signal produced by the differential amplifier 28 is determined by the processor 24, e.g., using a conventional fast Fourier transform algorithm, and then further processed to obtain the mass-to-charge ratio of the trapped ions.

By solving equation (1) for the boundary condition U(R2, 0)=0, the field curvature k is defined by the following equation:

$$k=2Ur\times(1/(R_m^2\times\ln(R_2/R_1)-\tfrac{1}{2}(R_2^2-R_1^2))) \quad (2).$$

Because the field curvature k is defined by equation (2) in terms of electrode geometry, the frequency ω of axial ion oscillations can be related to ion mass-to-charge ratio (m/z) by the following equation:

$$\omega=\mathrm{SQRT}(e\times k/(m/z)) \quad (3),$$

where e is the elemental charge. Equation (3) shows that the ion axial oscillation frequency (and hence the rn/z ratio) is independent of ion kinetic energy. Inserting (2) into (3) produces the following relationship:

$$\omega=\mathrm{SQRT}[(e/(m/z))\times(2Ur\times(1/(R_m^2\times\ln(R_2/R_1)-\tfrac{1}{2}(R_2^2-R_1^2))))] \quad (4).$$

Equation (4) shows that the frequency ω of ion oscillations is proportional to the square root of the potential Ur applied to the inner electrode 12, is correlated with the inner electrode maximum radius $R_1$ and is inversely correlated with the remaining radial dimensions of the orbitrap 11. Using equation (1), the shapes $z_{12}(r)$ and z Using equation (1), the radial shapes, i.e., contours, $z_{12}(r)$ and $z_{14}(r)$ of the outer and inner surfaces of the inner and outer electrodes 12, 14 respectively along the z direction can be deduced as follows:

$$z_{12}(r)=\mathrm{SQRT}[\tfrac{1}{2}r^2-\tfrac{1}{2}R_1^2+R_m^2\times\ln(R_1/r)] \quad (5).$$

$$z_{14}(r)=\mathrm{SQRT}[\tfrac{1}{2}r^2-\tfrac{1}{2}R_2^2+R_m^2\times\ln(R_2/r)] \quad (6).$$

Figure 2:
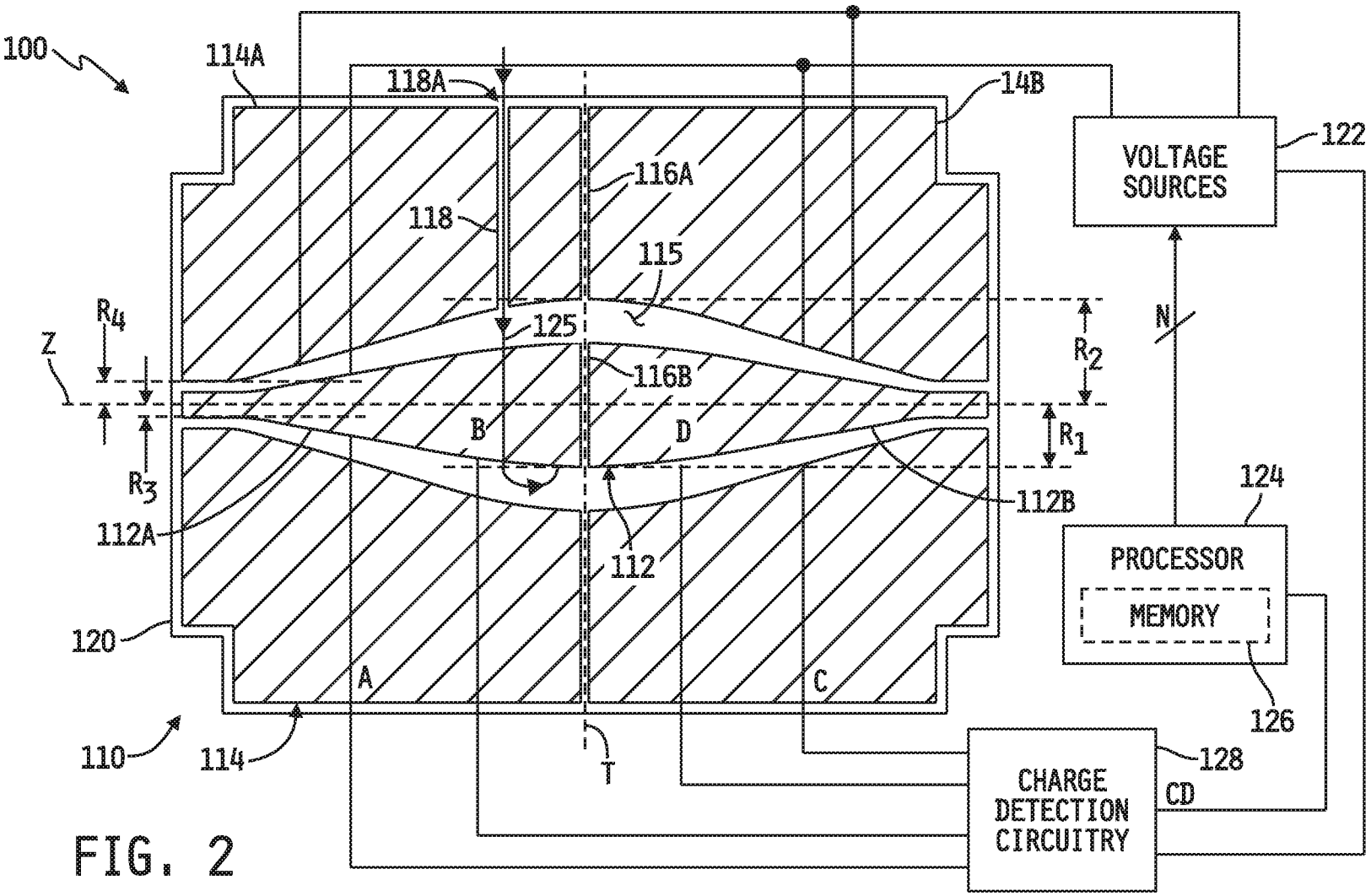
FIG. 2 is a simplified cross-sectional diagram of an embodiment of an orbitrap system including an embodiment of an orbitrap with control and measurement components coupled thereto, in accordance with the present disclosure.

Referring now to FIG. 2, an embodiment is shown of an orbitrap-based particle detection system 100 of a mass spectrometer or mass spectral analysis system in accordance with this disclosure. The system 100 illustratively includes an embodiment of an orbitrap 110 operatively coupled to control and measurement circuitry. As compared with the orbitrap 11 illustrated in FIG. 1 and described hereinabove, the orbitrap 110 of FIG. 2 is illustratively modified in structure and/or in certain geometric relationships of its components, as will be described in detail below, in order to optimize the charge measurement accuracy of the orbitrap 110 for single particle detection.

In the embodiment illustrated in FIG. 2, the orbitrap 110 includes an elongated, spindle-like inner electrode 112 surrounded by an outer barrel-like electrode 114, and the combination of the inner and outer electrodes 112, 114 is illustratively surrounded by a ground shield 120, e.g., an electrically conductive shield or chamber controlled to ground potential or other suitable potential. A z-axis of the orbitrap 11 extends centrally and axially through the inner electrode 112. The outer barrel-like electrode 114 is split between two axial halves 114A and 114B with a space 116A between the two halves generally aligned with the axial center of the inner electrode 112. The inner surfaces of the two axial halves 114A, 114B of the outer electrode 114 are illustratively mirror images of one another each positioned on either side of a transverse plane T passing centrally and transversely between the two halves 114A, 114B. In some embodiments, as illustrated by example in FIG. 2, the inner electrode 112 is also split into two axial halves 112A, 112B with a space 116B between the two halves generally aligned with the axial center of the inner electrode; i.e., such that the longitudinal axes of the spaces 116A, 116B are in-line with one another, i.e., co-linear, and such that the transverse plane T passes transversely between the two halves 112A, 112B. In such embodiments, the outer surfaces of the two axial halves 112A, 112B of the inner electrode 112 are illustratively mirror images of one another about the transverse plane T. In alternate embodiments, the inner electrode 112 may not be split into two axial halves 112A, 112B and may instead be provided in the form of a single, unitary body, i.e., such that the space 116B is omitted. In any case, a cavity 115 is formed between the inner surfaces of the outer electrodes 14A and 14B and the outer surface of the inner electrode 12, and the opposed surfaces the inner and outer electrodes 112, 114 are symmetrical about the longitudinal axis of the space 116A.

The outer surface of the inner electrode 112 has a maximum outer radius $R_1$ at its axial center, and the inner surface of the outer electrode 114 likewise has a maximum inner radius $R_2$ at its axial center. The outer surface of the inner electrode 112 illustratively tapers downwardly along the Z-axis from the maximum radius $R_1$ at its axial center to a reduced radius $R_3$ at or near each opposed end, i.e., such that $R_1>R_3$. The inner surface of the outer electrode 114 likewise illustratively tapers downwardly along the Z-axis from the maximum radius $R_2$ at its axial center to a reduced radius $R_4$ at or near each opposed end, i.e., such that $R_2>R_4$. Generally, $R_2>R_1>R_4>R_3$.

Each of the inner electrode 112 and the outer electrode 114 are electrically coupled to one or more voltage sources 122 operable to selectively apply control voltages to each. In the illustrated embodiment, the one or more voltage sources 122 are electrically connected to a processor 124 via N signal paths, where N may be any positive integer. A memory 126 illustratively has instructions stored therein which, when executed by the processor 124, cause the processor 124 to control the one or more voltage sources 122 to selectively apply control or operating voltages to each of the inner and outer electrodes 112, 114 respectively. In alternate embodiments, the one or more voltage sources 122 may be or include one or more programmable voltage sources which can be programmed to selectively apply control or operating voltages to either or both of the electrodes 112, 114. In some such embodiments, operation of the one or more such programmable voltage sources may be synchronized with the processor 124 in a conventional manner.

Each of the inner electrode 112 and the outer electrode 114 are electrically coupled to respective inputs of charge detection circuitry 128, and a charge detection output of the circuitry 128 is electrically coupled to the processor 124. The memory 126 illustratively has instructions stored therein which, when executed by the processor 124, cause the processor 124 to process the charge detection output signal CD produced by the circuitry 128 to determine mass-to-charge and charge information of a single particle trapped within the orbitrap 110. In embodiments in which the inner electrode 112 is provided in the form of a single, unitary body, the circuitry 128 may illustratively take the fora of a differential amplifier of the type illustrated in FIG. 1. In embodiments in which the inner electrode 112 is split into two equal, axially spaced inner electrode halves 112A, 112E as described above, the inner electrode 112 is illustratively used, in addition to the outer electrode 114, as an ion charge detector and the circuitry 128 illustratively include circuitry for combining the image charges induced on the four electrode halves 112A, 112B, 114A and 114B. Various examples embodiments of such circuitry 128 are depicted in FIGS. 5A-8 and will be described in detail below.

Some of the dimensions and relationships between various components of the orbitrap 110 illustrated in FIG. 2 are illustratively selected to optimize, or at least improve, the accuracy of charge measurements when trapping single charged particles. For example, the amount of charge induced by a single ion on the detection electrodes of an orbitrap depends on the position of the ion at the time of measurement, and as the ion oscillates along and orbits around the inner electrode the charge induced by the ion on the detection electrodes may thus vary. Moreover, since individual ions do not all follow identical trajectories, the fraction of the charge induced on the detection electrodes varies from ion to ion. In the normal mode of operation of an orbitrap, i.e., when trapping and processing an ensemble of ions, this latter variation is averaged away. However, for individual ions these variations contribute to an uncertainty in the charge measurements of single trapped ions. To optimize the orbitrap 110 illustrated in FIG. 2 for charge measurements of single ions, the geometries of various components of the orbitrap 110 are illustratively designed to increase the fraction of ion charge that is detected and to reduce the ion-to-ion variation in the fraction of the charge detected.

In order to increase the fraction of detected ion charge, the orbitrap 110 is illustratively designed to provide for consistency in the radial and axial trajectories of single charged particles trapped in the orbitrap 110. With respect to the radial ion trajectory, the following simplified equation relates the radial motion of an ion to a circular trajectory in which the radius, r, of the circular trajectory is a function of the kinetic energy and of the electric field within the cavity 115:

$$R=2\times E_k/F \quad (7),$$

where $E_k$ is the entrance kinetic energy, i.e., the kinetic energy of an ion entering the cavity 115, and F is the force experienced by the ion due to the electric field established within the cavity 115. Only a narrow distribution of ions close to the outer surface of the inner electrode 112 is trappable when the trapping electric field, resulting from application of corresponding potentials supplied by the one or more voltage sources 122, is applied. This distribution, along with the distribution of entrance kinetic energies, contributes to the radial distribution of ions in the orbitrap 110. The entrance kinetic energy required for trapping an ion in the orbitrap cavity 115 is defined by the following equation:

$$E_k=(k/4)\times(R_m^2-R^2)\times(R/R_i)^2 \quad (8),$$

where R is the final radial position of the ion in the trap (also referred to as the orbital radius of the ion) and $R_i$ is the injection radius of the ion, i.e., the radial position of the ion relative to the Z-axis when injected into the cavity 115. Equation (8) reveals that the effect on ion charge measurements of ion kinetic energy distribution is dependent on the ratio $R/R_i$, and that this effect can be minimized by maximizing the value of $R_1$ relative to the value of R. However, if only the outer electrode 114 is to be used to detect ion charge, then the orbital radius R should be maximized to increase the fraction of the ion's charge that is induced, and thus detectable, on the outer electrode 114. The range of values of the ratio $R/R_i$ is defined by the minimum and maximum values of $R_1$ and $R_2$.

The fraction of ion charge induced on the detection electrode also depends on the ion's trajectory along the Z-axis; more specifically, on how the fraction of induced charge changes relative to the geometries, i.e., the curved contours; of the outer surfaces of the inner electrode 112 and outer electrode 114 as an ion moves along the Z-axis. The radial shapes; i.e., curved contours, $z_{12}(r)$ and $z_{14}(r)$ of the outer and inner surfaces of the inner and outer electrodes 112, 114 respectively are defined by the equations (5) and (6) and are thus dependent primarily on the values of $R_1$, $R_2$ and $R_m$.

Figure 3:
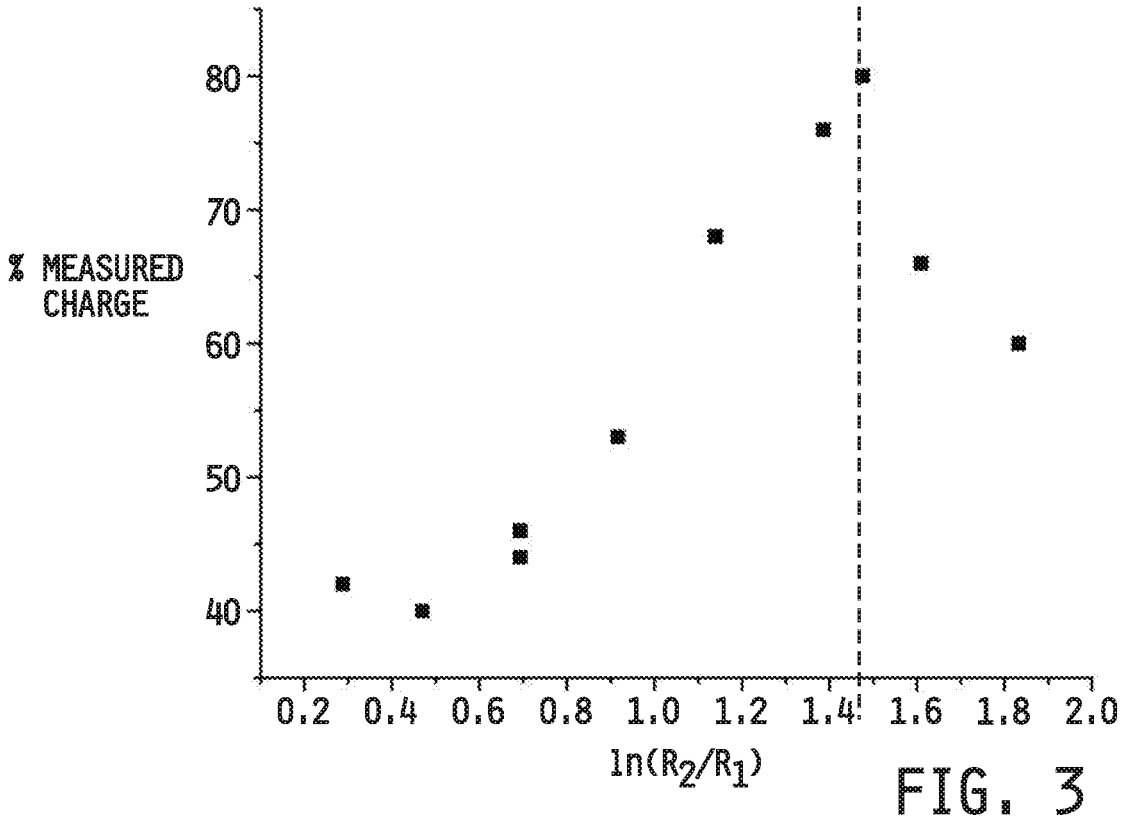
FIG. 3 is a plot of % measured charge vs the variable $\ln(R_2/R_1)$ of an orbitrap, wherein $R_2$ is the radius, relative to a longitudinal axis extending centrally through the inner electrode, of the inner surface of the outer electrode, and wherein $R_1$ is the radius, also relative to the longitudinal axis extending centrally through the inner electrode, of the outer surface of the inner electrode.
Figure 4:
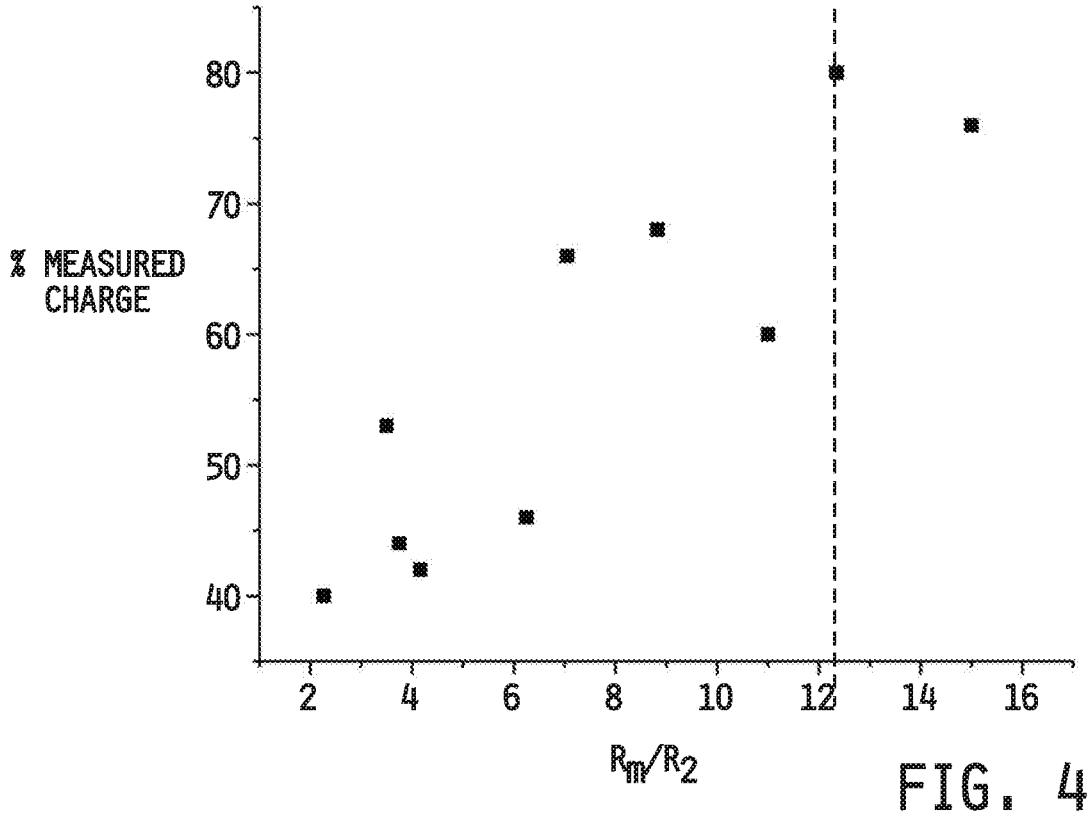
FIG. 4 is a plot of % measured charge vs the variable $R_m/R_2$ of an orbitrap, wherein $R_2$ is the radius, relative to the longitudinal axis extending centrally through the inner electrode, of the inner surface of the outer electrode, and wherein $R_m$ is a characteristic radius, also relative to the longitudinal axis extending centrally through the inner electrode, and is the radial distance from the longitudinal axis extending centrally through the inner electrode at which the electric field established between the inner and outer electrode no longer attracts ions toward the axis.

The values of $R_1$, $R_2$ and $R_m$, and the relationships therebetween; are thus the primary variables which influence the radial and axial trajectories of single charged particles trapped in the orbitrap 110, and are thus the primary variables which may be optimized to maximize the fraction of charge induced on the detection electrode. In this regard, a plot is shown in FIG. 3 of the fraction of measured charge induced by a single ion on the outer electrode 114 of an embodiment of the orbitrap 110 in which the inner electrode 112 is provided in the form of a single, unitary body as a function of the variable $\ln(R_2/R_1)$. As demonstrated by this plot, the fraction of measured charge induced on the outer electrode 114 increases with increasing $\ln(R_2/R_1)$, peaks at approximately 80% at an $\ln(R_2/R_1)$ value of approximately 1.48 (corresponding to $R_2/R_1$ of approximately 4.4), and then falls off again at higher $\ln(R_2/R_1)$ values. Another plot is shown in FIG. 4 of the fraction of measured charge induced by a single ion on the outer electrode 114 of the same orbitrap 110 as a function of the variable $R_m/R_2$. As demonstrated by this plot, the fraction of measured charge induced on the outer electrode 114 peaks at approximately 80% at an $R_m/R_2$ value of approximately 12.2. Integration of the ratios of FIGS. 3 and 4 which correlate to an 80% measured charge fraction into the design of the orbitrap 110 illustrated in FIG. 2 results in larger $\ln(R_2/R_1)$ and $R_m/R_2$ as compared with the orbitrap 11 illustrated in FIG. 1. Larger $\ln(R_2/R_1)$ and $R_m/R_2$, in turn, increase the fraction of measured charge by increasing the ion orbital radius R and the oscillation distance along the Z-axis of the orbitrap 110 relative to the orbitrap 11.

Simulations were run comparing the measured fraction of charge induced by a single trapped ion on the outer electrode 14 of two different conventional orbitraps 11 of the type illustrated in FIG. 1 with the fraction of charge induced by a single trapped ion on the outer electrode 114 of the orbitrap 110 of FIG. 2 without a split inner electrode 112 (i.e., with a single, unitary inner electrode 112) in which the optimum values of the ratios illustrated in FIGS. 3 and 4 were implemented. The first geometry of the orbitrap 11 that was simulated was a conventional configuration in which $\ln(R_2/R_1)=0.916$ and $R_m=\sqrt{2}R_2$. For this geometry, the average fraction of measured charge (of an ion with a charge of 100 e) was 52.9% with a standard deviation of 5.93%. The uncertainty results from ions with different trajectories in the orbitrap. In a second geometry of the orbitrap 11, a conventional "high-field" geometry was simulated in which $\ln(R_2/R_1)=0.470$ and $R_m=12117$. For this geometry, the average fraction of measured charge (of an ion with a charge of 100 e) was 45.7% with a standard deviation of 9.85%.

In the orbitrap 110 of FIG. 2, increasing $\ln(R_1/R_2)$ to or near the optimum ratio suggested by FIG. 3 results in a larger cavity 115 between the electrodes 112, 114, thus allowing for more of the ion charge to be picked up by the outer electrode 114. In addition to more signal being picked up, expanding the distance between the inner and outer electrodes 112, 114 allows the entrance position 118A, 118 of the ions along the Z-axis to be moved away from the center space 116A, as illustrated by example in FIG. 2, while also ensuring R $R_i$. As further illustrated by the ion trajectory 125 in FIG. 2, for example, ions enter the orbitrap 110 via the opening 118A and extend down through the space 118 into the cavity 115, wherein the space 118 is axially spaced apart from the center space 116A. Once within the cavity 115, the ion trajectory 125 includes a combination of orbital motion about the inner electrode 112 and oscillations along the inner electrode 112 in the direction of the Z-axis as described above. Moreover, increasing the gap between the inner and outer electrodes 112, 114, in combination with the decreased curvatures of the outer and inner surfaces of the inner and outer electrodes 112, 114 respectively resulting from increasing $R_m/R_2$ to or near the optimum ratio suggested by FIG. 4, results in a longer cavity 115 in the direction of the Z-axis, thereby increasing the oscillation distance of the ion along the Z-axis. This, in effect, increases the difference between the maximum and the minimum signal values detected at the split electrodes 114A, 114B of the outer electrode 114, and with the signal thus spanning a larger range more precise ion charge measurements are made. The geometry of the orbitrap 110 that was first simulated was a configuration in which the inner electrode 112 was a single, unitary body, $\ln(R_2/R_1)=1.48$ and $R_m/R_{2=12.2}$. For this geometry, the average fraction of measured charge (of an ion with a charge of 100 e) was 81.6% with a standard deviation of 1.17%, which demonstrates a substantial improvement over the conventional orbitrap geometries described above.

In the embodiment illustrated in FIG. 2, the inner electrode 112 is illustratively shown split axially into two equal halves 112A, 112B with a gap 116B axially separating the two halves 112A, 112E along the Z-axis. In this embodiment, the inner electrode 112, like the outer electrode 114, may be used to detect ion charge induced on each of the two halves 112A, 112B as the ion oscillates along the Z-axis. Using the inner electrode 112 as a second set of detection electrodes 112A, 112B results in an increase in the measurable fraction of ion charge. If the potentials applied to the inner and outer electrodes 112, 114 during trapping are equal and opposite to one another, the charge induced on the electrodes 112A, 112B, 114A, 114B can be measured by detecting and combining the four charge signals A, B, C and D with the circuitry 128 depicted in FIG. 2.

Figure 5A:
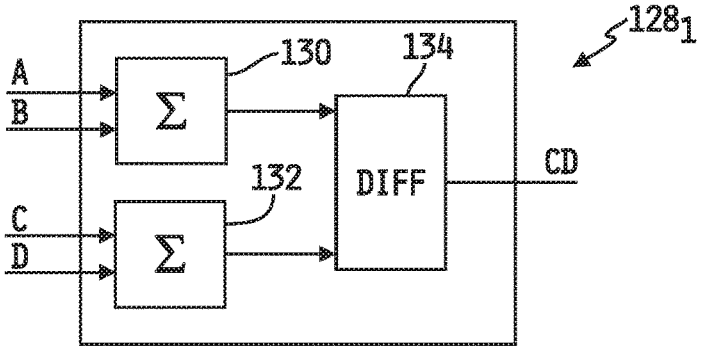
FIG. 5A is a simplified block diagram of an embodiment of the charge detection circuitry depicted in FIG. 2.

Referring now to FIG. 5A, an embodiment $\mathbf{128}_1$ of the charge detection circuitry 128 of FIG. 2 is shown. In the illustrated embodiment, the signals A and B, corresponding to the induced ion charge measured on the outer electrode 114A and on the inner electrode 112A respectively, are added together using a signal summing circuit 130. The signals C and D, corresponding to the induced ion charge measured on the outer electrode 114E and on the inner electrode 112B respectively, are likewise added together using another signal summing circuit 132. The outputs of the summing circuits 130 and 132 are applied as inputs to a difference amplifier 134, and the charge detection signal CD produced by the circuitry $\mathbf{128}_1$ is thus CD=(A+B) (C+D). Those skilled in the art will recognize that the summing circuits 130, 132 and the differential amplifier 134 may be implemented using any known design(s), and it will be understood that any such design(s) is/are intended to fall within the scope of this disclosure. Those skilled in the art will further recognize that only the functional components of the embodiment $\mathbf{128}_1$ of the circuitry 128 illustrated in FIG. 5A are depicted, and that the circuitry $\mathbf{128}_1$ may alternatively or additionally include other conventional circuit components such as, but not limited to, one or more capacitors between each of the electrodes 112A, 112B, 114A, 114B and a corresponding input of the circuitry $\mathbf{128}_1$, one or more capacitors between the inner electrode 112 and the outer electrode 114 and the like.

Figure 5B:
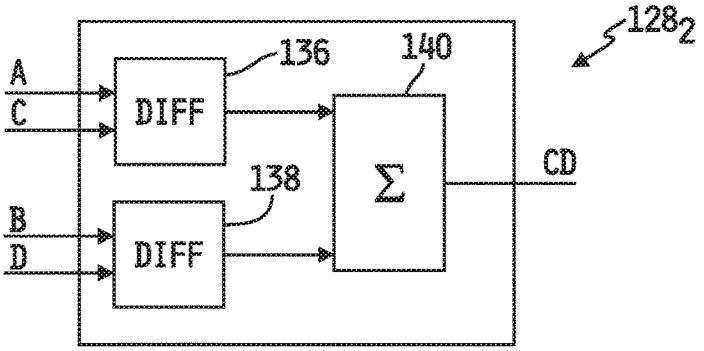
FIG. 5B is a simplified block diagram of another embodiment of the charge detection circuitry depicted in FIG. 2.

Referring now to FIG. 5B, another embodiment $\mathbf{128}_2$ of the charge detection circuitry 128 of FIG. 2 is shown. In the illustrated embodiment, the signals A and C, corresponding to the induced ion charge measured on the outer electrodes 114A and 114B, respectively, are provided as inputs to a first differential amplifier 136, the signals C and D, corresponding to the induced ion charge measured on the inner electrodes 114A and 114B, respectively, are likewise provided as inputs to a second differential amplifier 138, and the outputs of the two differential amplifiers 136, 138 are added together using a signal summing circuit 140. The output of the signal summing circuit 140 is the charge detection signal CD produced by the circuitry $\mathbf{128}_1$, and is thus CD=(A—C)+(B—D). Those skilled in the art will recognize that the differential amplifiers 136, 136 and the signal summing circuit 140 may be implemented using any known design(s), and it will be understood that any such design(s) is/are intended to fall within the scope of this disclosure. Those skilled in the art will further recognize that only the functional components of the embodiment $\mathbf{128}_2$ of the circuitry 128 illustrated in FIG. 5B are depicted, and that the circuitry $\mathbf{128}_2$ may alternatively or additionally include other conventional circuit components such as, but not limited to, any one or more of the circuit components described above with respect to FIG. 5A.

Figure 6A:
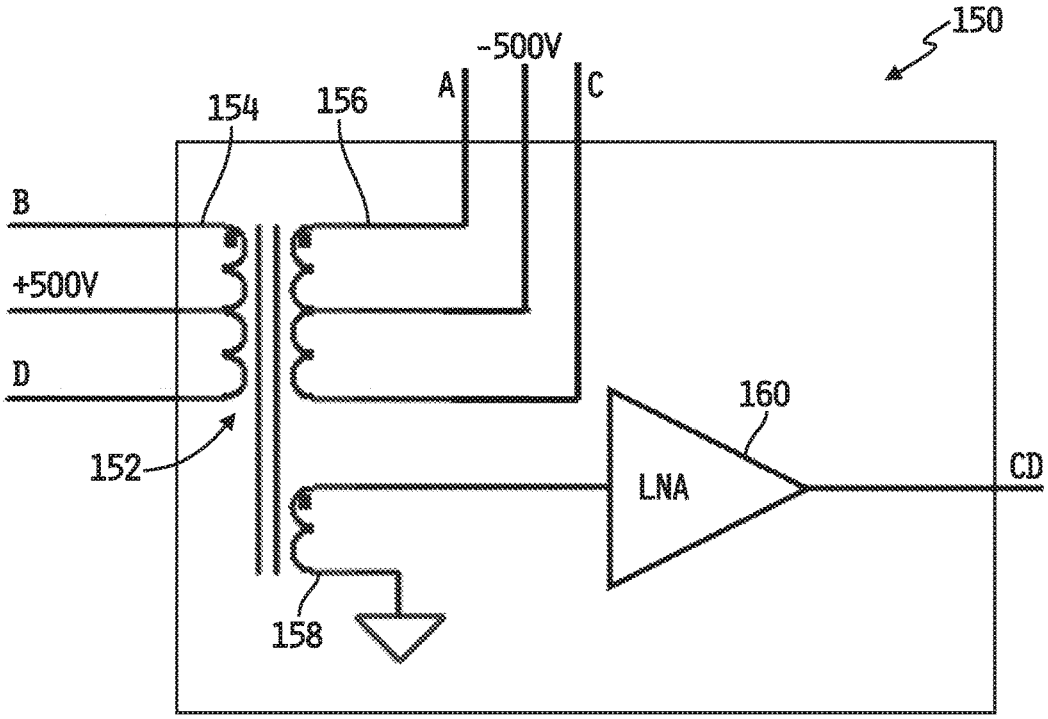
FIG. 6A is a simplified schematic diagram of an embodiment of the charge detection circuitry of the type illustrated in FIG. 5A.

Referring now to FIG. 6A, an embodiment 150 of the charge detection circuitry $\mathbf{128}_1$ depicted in FIG. 5A is shown. In the illustrated embodiment, the circuitry 150 includes a conventional transformer 152 to combine the signals A D according to the arrangement described with respect to FIG. 5A. In particular, the signals B and D are applied to opposite ends of a primary coil 154, and the signals A and C are applied to opposite ends of a secondary coil 156. A center tap of the primary coil 154 receives a positive voltage, e.g., 500 volts, from one of the voltage sources 122, and the center tap of the secondary coil receives an equal and opposite negative voltage, e.g., −500 volts, from one of the voltage sources 122. In one embodiment, the center tap voltages (+500 v and −500 v) are the same as those applied to the outer and inner electrodes 114, 112 respectively during ion trapping. In any case, an auxiliary secondary coil 158 of the transformer 152 is electrically coupled to an input of a signal amplifier 160, e.g., a conventional low-noise amplifier, and the output of the amplifier 160 is the charge detection signal CD. The transformer 152 illustratively adds together the signals A and B, corresponding to the signals on the outer electrode 114A and the inner electrode 112A respectively, and likewise adds together the signals C and D, corresponding to the signals on the outer electrode 114B and the inner electrode 112B respectively, and the difference between these added signals (A+B) and (C+D) is induced in the auxiliary secondary coil 158, which is amplified to produce the charge detection signal CD—(A+B)−(C+D).

Figure 6B:
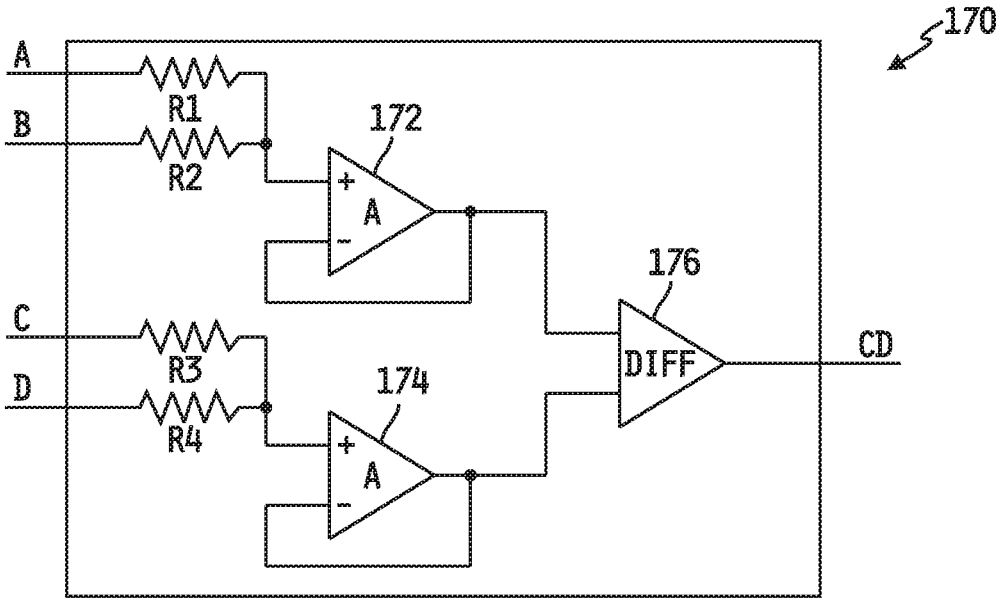
FIG. 6B is a simplified schematic diagram of another embodiment of the charge detection circuitry of the type illustrated in FIG. 5A.

Referring now to FIG. 6B, another embodiment 170 of the charge detection circuitry $\mathbf{128}_1$ depicted in FIG. 5A is shown. In the illustrated embodiment, the circuitry 170 includes a first unity gain signal adding amplifier 172 with the signals A and B fed through resistors $R_1$ and $R_2$ respectively to the + input of the amplifier 172, and with the output of the amplifier 172 fed back to the − input. Illustratively, $R_1$=$R_2$ and the output of the amplifier 172 is thus A+B, The circuitry 170 further includes a second unity gain signal adding amplifier 174 with the signals C and D fed through resistors $R_3$ and $R_4$ respectively to the + input of the amplifier 174, and with the output of the amplifier 174 fed back to the − input. Illustratively, $R_3$=$R_4$ (and also equal to $R_1$ and $R_2$) and the output of the amplifier 174 is thus C+D. The outputs of the amplifiers 172, 174 are applied as inputs to a conventional differential amplifier 176, and the output of the differential amplifier 176 is the charge detection signal CD=(A+B)−(C+D).

Figure 7:
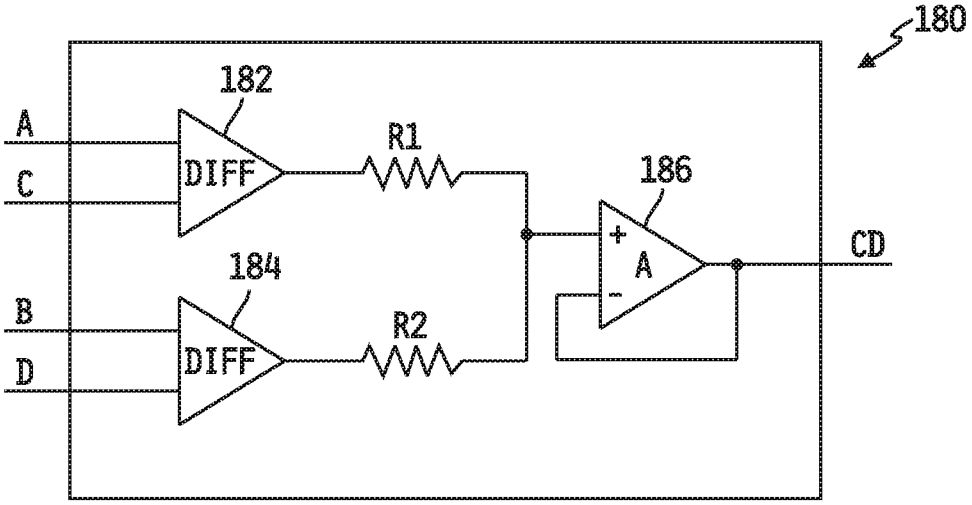
FIG. 7 is a simplified schematic diagram of an embodiment of the charge detection circuitry of the type illustrated in FIG. 53.

Referring now to FIG. 7, an embodiment 180 is shown of the charge detection circuitry $\mathbf{128}_2$ depicted in FIG. 5B. In the illustrated embodiment, the circuitry 180 includes a first conventional differential amplifier 182 receiving as inputs the signals A and C, and a second conventional differential amplifier 184 receiving as inputs the signals B and D. The outputs of the differential amplifiers 182, 184 are fed through resistors $R_1$ and $R_2$ respectively to the + input of a conventional unity gain amplifier 186, and the output of the amplifier 186 is fed back to the input. Illustratively, $R_1$=$R_2$ and the output of the amplifier 186 is thus the sum of the difference signals (A-C) and (B-D) produced by the difference amplifiers 182, 184 respectively, such that the charge detection signal output CD of the amplifier 186 is CD=(A−C)+(B−D).

Figure 8:
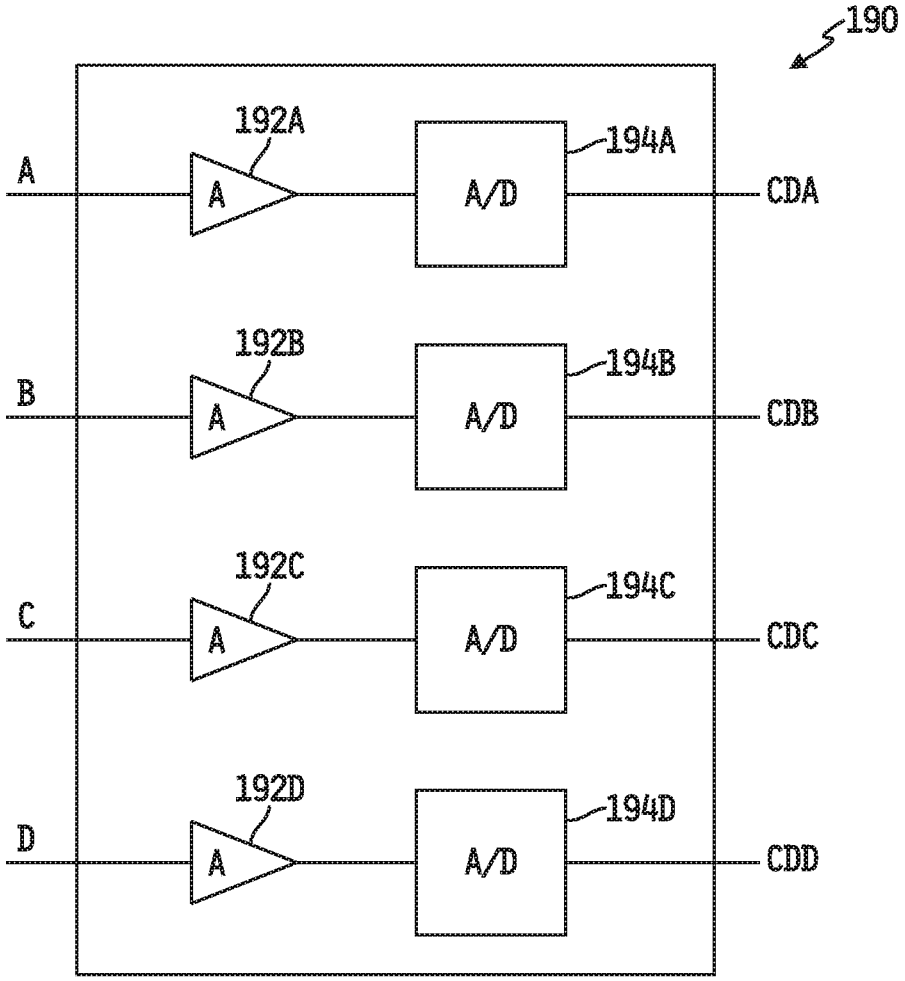
FIG. 8 is a simplified block diagram of still another embodiment of the charge detection circuitry depicted in FIG. 2.

Referring now to FIG. 8, another embodiment 190 of the charge detection circuitry 128 of FIG. 2 is shown. In the illustrated embodiment, the circuitry 190 illustratively includes four conventional amplifiers 192A 192D each receiving as an input a respective one of the signals A D described above. The outputs of the amplifiers 192A 192D are each provided to an input of a respective one of four conventional analog-to-digital (A/D) converter circuits 194A 194D. The outputs of the A/D converter circuits 194A 194D are digital representations of the charge detection signals CDA, CDB, CDC and CDD respectively, which are supplied as inputs to the processor 124, In this embodiment, the memory 126 illustratively includes instructions which, when executed by the processor 124, cause the processor 124 to combine the signals CDA CDD to produce a digital charge detection signal CDS according to the arrangement iliustrated in FIG. 5A, i.e., CDS=(CDA+CDB)−(CDC+CDD), or according to the arrangement illustrated in FIG. 5B, i.e., CDS=(CDA−CDC)+(CDB−CDD).

Those skilled in the art will recognize that, in some of the embodiments, e.g., those illustrated in FIGS. 6A 8, inherent circuit component mismatches and/or in the operation of such circuit components, may (or may not) lead to errors in the determination of the charge detection signal, CD (or CDS). Those skilled in the art will further recognize that in some cases, such errors may be eliminated or acceptably minimized or reduced using conventional circuit design techniques. In other cases, such errors may be eliminated or acceptably minimized or reduced by providing the entire circuitry 170, 180 or 190 in the form of a single, monolithic, application-specific integrated circuit. It will be understood that any such error elimination, reduction or minimization technique or structure is intended to fall within the scope of this disclosure.

Simulations were also run comparing the measured fraction of charge induced by a single trapped ion on the combination of two outer electrodes 14 and two (split) inner electrodes implemented in the two different conventional orbitraps 11 described above with the fraction of charge induced by a single trapped ion on the combination of the two outer electrodes 114A and 114B and the two (split) inner electrodes 112A, 112B of the orbitrap 110 of FIG. 2 in which the optimum values of the ratios illustrated in FIGS. 3 and 4 were also implemented. The first geometry of the orbitrap 11 that was simulated was a conventional configuration in which ln(R2/R1)–0.916 and $R_m=\sqrt{2}R2$ as before. For this geometry, using the split inner electrode, the average fraction of measured charge (of an ion with a charge of 100 e) increased dramatically to 98.5% with a standard deviation of 0.274%. In the second geometry of the orbitrap 11, the conventional "high-field" geometry was simulated in which $\ln(R_2/R_1)=0.470$ and $R_m=\sqrt{2}R2$ also as before. For this geometry, using the split inner electrode, the average fraction of measured charge (of an ion with a charge of 100 e) was 97.0% with a standard deviation of 0.804%. In the orbitrap 110 of FIG. 2 in which the split inner electrode 112A, 112B was implemented and which was otherwise as described above in the previous simulation, the uncertainty in the charge determination was reduced from 1.71% to 0.15%.

Thus, regardless of the geometries of the orbitrap components, splitting the inner electrode into axial halves and using all four of the electrode halves to measure the induced ion charge results in a reduction in the charge uncertainty as compared with the same instrument in which a single, unitary inner electrode is implemented. Because the induced charge on the inner and outer detection electrodes on each side of the orbitrap are summed and the two sums are then subtracted from one another, the effects of differences in curvature between the MO sets of inner and outer electrodes on measured charge can be reduced. Substantial improvements in charge detection error can be realized in orbitraps having large differences in curvature between the inner and outer electrodes, such as those found in conventional orbitraps. Implementing a split inner electrode in such conventional orbitraps results in the percent measured charge approaching 100% as just described in the above simulations, thus demonstrating that substantial improvements in charge measurement accuracy can be realized in conventional orbitraps without modifying the geometric parameters of the orbitrap in the manner described herein. However, the combination of implementing a split inner electrode and optimizing the geometric parameters of an orbitrap as described herein yields the highest degree of charge measurement accuracy as also demonstrated in the above-described simulations.

Figure 9A:
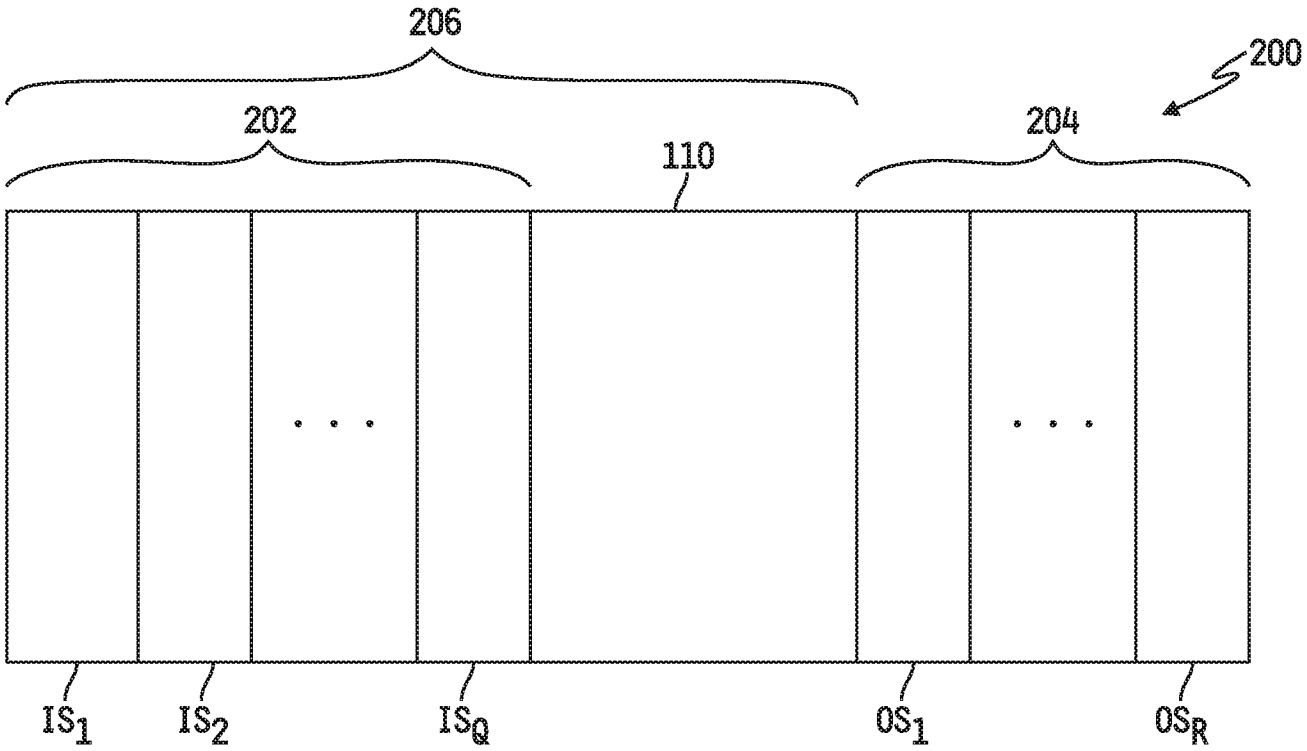
FIG. 9A is a simplified block diagram of an embodiment of an ion separation instrument including an orbitrap of the type illustrated in FIG. 2, showing example ion processing instruments which may form part of the ion source upstream of the orbitrap and/or which may be disposed downstream of the orbitrap to further process ion(s) exiting the orbitrap.

Referring now to FIG. 9A, a simplified block diagram is shown of an embodiment of an ion separation instrument 200 which may include any embodiment of the orbitrap 110 described herein, which may include an ion source 202 upstream of the orbitrap 110 and/or which may include at least one ion processing instrument 204 disposed downstream of the orbitrap 110 and configured to process ion(s) exiting the orbitrap 110. In some embodiments which include at least one ion processing instrument 204 disposed downstream of the orbitrap 110, voltages applied to the inner and outer electrodes 112, 114 may illustratively be controlled to allow ions to exit axially from the orbitrap 110, i.e., axially from the cavity 115 defined between the inner and outer electrodes 112, 114, or to allow ions to exit radially from the central or center space 116A. In other embodiments which include at least one ion processing instrument 204 disposed downstream of the orbitrap 110, the orbitrap 110 may be modified to include another ion passageway and opening through the outer electrode 114, e.g., similar or identical to the opening 118A and passageway 118 illustrated in FIG. 2, and voltages applied to the inner and outer electrodes 112, 114 may illustratively be controlled to allow ions to exit axially from such an ion passageway and opening.

The on source 202 illustratively includes at least one conventional ion generator configured to generate ions from a sample. The ion generator may be, for example, but not limited to, one or any combination of at least one ion generating device such as an electrospray ionization source, a matrix-assisted laser desorption ionization (MALDI) source or the like. In some embodiments, the ion source 202 may further include any number of ion processing instruments configured to act on some or all of the generated ions prior to detection by the orbitrap 110 as described above. In this regard, the ion source 202 is illustrated in FIG. 9A as including a number, Q, of ion source stages $IS_1$-$IS_Q$ which may be or form part of the ion source 202, where Q, may be any positive integer. The ion source stage $IS_1$ will typically be or include one or more conventional sources of ions as described above. The ion source stage(s) $IS_2$-$IS_Q$, in embodiments which include one or more such stages, may illustratively be or include one or more conventional instruments for separating ions according to one or more molecular characteristics (e.g., according to ion mass, charge, ion mass-to-charge, ion mobility, ion retention time, or the like) and/or one or more conventional ion processing instruments for collecting and/or storing ions (e.g., one or more quadrupole, hexapole and/or other ion traps), for filtering ions (e.g., according to one or more molecular characteristics such as ion mass, charge, ion mass-to-charge, ion mobility, ion retention time and the like), for fragmenting or otherwise dissociating ions, for normalizing or shifting ion charge states, and the like. It will be understood that the ion source 202 may include one or any combination, in any order, of any such conventional ion sources, ion separation instruments and/or ion processing instruments, and that some embodiments may include multiple adjacent or spaced-apart ones of any such conventional ion sources, ion separation instruments and/or ion processing instruments. In embodiments in which the ion source 202 includes one or more instruments for separating particles according to ion mass, charge, or mass-to-charge ratio, the ion source 202 and the orbitrap 110 illustratively together form a conventional charge detection mass spectrometer (CAMS) 206 as illustrated in FIG. 9A.

In some embodiments, the instrument 200 may include an ion processing instrument 204 coupled to the ion outlet of the orbitrap 110. As illustrated by example in FIG. 9A, the ion processing instrument 204, in embodiments which include it, may be provided in the form of any number of ion separating and/or processing stages $OS_1$-$OS_R$, where R may be any positive integer. Examples of the one or more of the ion separating and/or processing stages $OS_1$-$OS_R$ may include, but are not limited to, one or more conventional instruments for separating ions according to one or more molecular characteristics (e.g., according to ion mass, charge, ion mass-to-charge, ion mobility, ion retention time, or the like), one or more conventional instruments for collecting and/or storing ions (e.g., one or more quadrupole, hexapole and/or other ion traps), one or more conventional instruments for filtering ions (e.g., according to one or more molecular characteristics such as ion mass, charge, ion mass-to-charge, ion mobility, ion retention time and the like), one or more conventional instruments for fragmenting or otherwise dissociating ions, one or more conventional instruments for normalizing or shifting ion charge states, and the like. It will be understood that the ion processing instrument 204 may include one or any combination, in any order, of any such conventional ion separation instruments and/or ion processing instruments, and that some embodiments may include multiple adjacent or spaced-apart ones of any such conventional ion separation instruments and/or ion processing instruments. In any implementation which the ion source 202 and/or the ion processing instruments 204 includes one or more mass spectrometers, any one or more such mass spectrometers may be of any conventional design including, for example, but not limited to a time-of-flight (TOF) mass spectrometer, a reflectron mass spectrometer, a Fourier transform ion cyclotron resonance (FTICR) mass spectrometer, a quadrupole mass spectrometer, a triple quadrupole mass spectrometer, a magnetic sector mass spectrometer, or the like.

As one specific implementation of the ion separation instrument 200 illustrated in FIG. 9A, which should not be considered to be limiting in any way, the ion source 202 illustratively includes 3 stages, and the ion processing instrument 204 is omitted. In this example implementation, the ion source stage $IS_1$ is a conventional source of ions, e.g., electrospray, MALDI or the like, the ion source stage $IS_2$ is a conventional ion filter, e.g., a quadrupole or hexapole ion guide, and the ion source stage $IS_3$ is a mass spectrometer of any of the types described above. In this embodiment, the ion source stage $IS_2$ is controlled in a conventional manner to preselect ions having desired molecular characteristics for analysis by the downstream mass spectrometer, and to pass only such preselected ions to the mass spectrometer, wherein the ions analyzed by the orbitrap 110 will be the preselected ions separated by the mass spectrometer according to mass-to-charge ratio. The preselected ions exiting the ion filter may, for example, be ions having a specified ion mass, charge, or mass-to-charge ratio, ions having ion masses, charges, or ion mass-to-charge ratios above and/or below a specified ion mass, charge, or ion mass-to-charge ratio, ions having ion masses, charges, or ion mass-to-charge ratios within a specified range of ion mass, charge, or ion mass-to-charge ratio, or the like. In some alternate implementations of this example, the ion source stage $IS_2$ may be the mass spectrometer and the ion source stage $IS_3$ may be the ion filter, and the ion filter may be otherwise operable as just described to preselect ions exiting the mass spectrometer which have desired molecular characteristics for analysis by the downstream orbitrap 110. In other alternate implementations of this example, the ion source stage $IS_2$ may be the ion filter, and the ion source stage $IS_3$ may include a mass spectrometer followed by another ion filter, wherein the ion filters each operate as just described.

As another specific implementation of the ion separation instrument 200 illustrated in FIG. 9A, which should not be considered to be limiting in any way, the ion source 202 illustratively includes 2 stages, and the ion processing instrument 204 is again omitted. In this example implementation, the ion source stage $IS_1$ is a conventional source of ions, e.g., electrospray, MALDI or the like, the ion source stage $IS_2$ is a conventional mass spectrometer of any of the types described above. In this implementation, the instrument 200 takes the form of a charge detection mass spectrometer (ODMS) 206 in which the orbitrap 110 is operable to analyze ions exiting the mass spectrometer.

As yet another specific implementation of the ion separation instrument 200 illustrated in FIG. 9A, which should not be considered to be limiting in any way, the ion source 202 illustratively includes 2 stages, and the ion processing instrument 204 is omitted. In this example implementation, the ion source stage $IS_1$ is a conventional source of ions, e.g., electrospray, MALDI or the like, and the ion source stage $IS_2$ is a conventional single or multiple-stage ion mobility spectrometer. In this implementation, the ion mobility spectrometer is operable to separate ions, generated by the ion source stage $IS_1$, over time according to one or more functions of ion mobility, and the orbitrap 110 is operable to analyze ions exiting the ion mobility spectrometer. In an alternate implementation of this example, the ion processing instrument 204 may include a conventional single or multiple-stage ion mobility spectrometer as a sole stage $OS_1$ (or as stage $OS_1$ of a multiple-stage instrument 210). In this alternate implementation, the orbitrap 110 is operable to analyze ions generated by the ion source stage $IS_1$, and the ion mobility spectrometer $OS_1$ is operable to separate ions exiting the orbitrap 110 over time according to one or more functions of ion mobility. As another alternate implementation of this example, single or multiple-stage ion mobility spectrometers may follow both the ion source stage $IS_1$ and the orbitrap 110. In this alternate implementation, the ion mobility spectrometer following the ion source stage $IS_1$ is operable to separate ions, generated by the ion source stage $IS_1$, over time according to one or more functions of ion mobility, the orbitrap 110 is operable to analyze ions exiting the ion source stage ion mobility spectrometer, and the ion mobility spectrometer of the ion processing stage $OS_1$ following the orbitrap 110 is operable to separate ions exiting the orbitrap 110 over time according to one or more functions of ion mobility. In any implementations of the embodiment described in this paragraph, additional variants may include a mass spectrometer operatively positioned upstream and/or downstream of the single or multiple-stage ion mobility spectrometer in the ion source 202 and/or in the ion processing instrument 204.

As still another specific implementation of the ion separation instrument 200 illustrated in FIG. 9A, which should not be considered to be limiting in any way, the ion source 202 illustratively includes 2 stages, and the ion processing instrument 204 is omitted. In this example implementation, the ion source stage $IS_1$ is a conventional liquid chromatograph, e.g., HPLC or the like configured to separate molecules in solution according to molecule retention time, and the ion source stage $IS_2$ is a conventional source of ions, e.g., electrospray or the like. In this implementation, the liquid chromatograph is operable to separate molecular components in solution, the ion source stage $IS_2$ is operable to generate ions from the solution flow exiting the liquid chromatograph, and the orbitrap 110 is operable to analyze ions generated by the ion source stage $IS_2$. In an alternate implementation of this example, the ion source stage $IS_1$ may instead be a conventional size-exclusion chromatograph (SEC) operable to separate molecules in solution by size. In another alternate implementation, the ion source stage $IS_1$ may include a conventional liquid chromatograph followed by a conventional SEC or vice versa. In this implementation, ions are generated by the ion source stage $IS_2$ from a twice separated solution; once according to molecule retention time followed by a second according to molecule size, or vice versa. In any implementations of the embodiment described in this paragraph, additional variants may include a mass spectrometer operatively positioned between the ion source stage $IS_2$ and the orbitrap 110.

Figure 9B:
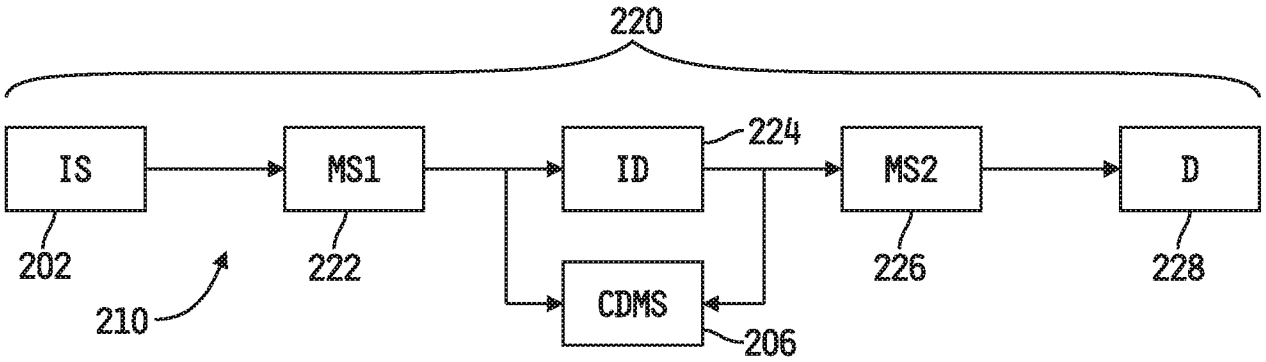
FIG. 9B is a simplified block diagram of another embodiment of an on separation instrument including a CDMS instrument including or in the form of an orbitrap of the type illustrated in FIG. 2, showing an example implementation which combines conventional ion processing instruments with the orbitrap and/or with a CDMS system in which the orbitrap is implemented as the charged particle detector.

Referring now to FIG. 9B, a simplified block diagram is shown of another embodiment of an ion separation instrument 210 which illustratively includes a multi-stage mass spectrometer instrument 220 and which also includes the CDMS 206 including the orbitrap 110, i.e., an orbitrap-based CDMS 206 as described above, implemented as a high-mass ion analysis component. In the illustrated embodiment, the multi-stage mass spectrometer instrument 220 includes an ion source (IS) 202, as illustrated and described herein, followed by and coupled to a first conventional mass spectrometer (MS1) 222, followed by and coupled to a conventional ion dissociation stage (ID) 224 operable to dissociate ions exiting the mass spectrometer 222, e.g., by one or more of collision-induced dissociation (CID), surface-induced dissociation (SID), electron capture dissociation (ECD) and/or photo-induced dissociation (PID) or the like, followed by and coupled to a second conventional mass spectrometer (MS2) 226, followed by a conventional ion detector (D) 228, e.g., such as a microchannel plate detector or other conventional ion detector. The CDMS 206, is coupled in parallel with and to the ion dissociation stage 224 such that the CDMS 206 may selectively receive ions from the mass spectrometer 222 and/or from the ion dissociation stage 224.

MS/MS, e.g., using only the ion separation instrument 220, is a well-established approach where precursor ions of a particular molecular weight are selected by the first mass spectrometer 222 (MS1) based on their m/z value. The mass selected precursor ions are fragmented, e.g., by collision-induced dissociation, surface-induced dissociation, electron capture dissociation or photo-induced dissociation, in the ion dissociation stage 224. The fragment ions are then analyzed by the second mass spectrometer 226 (MS2). Only the m/z values of the precursor and fragment ions are measured in both MS1 and MS2. For high mass ions, the charge states are not resolved and so it is not possible to select precursor ions with a specific molecular weight based on the m/z value alone. However, by coupling the instrument 220 to the CDMS 206 as illustrated in FIG. 93, it is possible to select a narrow range of m/z values and then use the CDMS 206 to determine the masses of the m/z selected precursor ions. The mass spectrometers 222, 226 may be, for example, one or any combination of a magnetic sector mass spectrometer, time-of-flight mass spectrometer or quadrupole mass spectrometer, although in alternate embodiments other mass spectrometer types may be used. In any case, the m/z selected precursor ions with known masses exiting MS1 can be fragmented in the ion dissociation stage 224, and the resulting fragment ions can then be analyzed by MS2 (where only the m/z ratio is measured) and/or by the CDMS instrument 206 (where the m/z ratio and charge are measured simultaneously). Low mass fragments, i.e., dissociated ions of precursor ions having mass values below a threshold mass value, e.g., 10,000 Da (or other mass value), can thus be analyzed by conventional MS, using MS2, while high mass fragments (where the charge states are not resolved), i.e., dissociated ions of precursor ions having mass values at or above the threshold mass value, can be analyzed by the CDMS 206.

It will be understood that one or more charge detection optimization techniques may be used with the orbitrap 110 alone and/or in any of the systems 200, 210 illustrated in the attached figures and described herein e.g., for charge detection events. Examples of some such charge detection optimization techniques are illustrated and described in U.S. Patent Application Ser. No. 62/680,296, filed Jun. 4, 2018 and in International Patent Application No. PCT/US2019/013280, filed Jan. 11, 2019, both entitled APPARATUS AND METHOD FOR CAPTURING IONS IN AN ELECTROSTATIC LINEAR ION TRAP, the disclosures of which are both expressly incorporated herein by reference in their entireties.

It will be further understood that one or more charge calibration or resetting apparatuses may be used with the inner and/or outer electrodes of the orbitrap 110 alone and/or in any of the systems 200, 210 illustrated in the attached figures and described herein. An example of one such charge calibration or resetting apparatus is illustrated and described in U.S. Patent Application Ser. No. 62/680,272, filed Jun. 4, 2018 and in International Patent Application No. PCT/US2019/013284, filed Jan. 11, 2019, both entitled APPARATUS AND METHOD FOR CALIBRATING OR RESETTING A CHARGE DETECTOR, the disclosures of which are both expressly incorporated herein by reference in their entireties.

It will be still further understood that one or more ion source optimization apparatuses and/or techniques may be used with one or more embodiments of a source from which ions entering the orbitrap 110 are generated, such as in the source 202 in any of the systems 200, 210 illustrated and described herein, some examples of which are illustrated and described in U.S. Patent Application Ser. No. 62/680,223, filed Jun. 4, 2018 and entitled HYBRID ION FUNNEL-ION CARPET (FUNPET) ATMOSPHERIC PRESSURE INTERFACE FOR CHARGE DETECTION MASS SPECTROMETRY, and in co-pending International Patent Application No. PCT/US2019/013274, filed Jan. 11, 2019 and entitled INTERFACE FOR TRANSPORTING IONS FROM AN ATMOSPHERIC PRESSURE ENVIRONMENT TO A LOW PRESSURE ENVIRONMENT, the disclosures of which are both expressly incorporated herein by reference in their entireties.

It will be yet further understood that the orbitrap 110 alone and/or implemented in any of the systems 200, 210 illustrated in the attached figures and described herein may be implemented in systems configured to operate in accordance with real-time analysis and/or real-time control techniques, some examples of which are illustrated and described in U.S. Patent Application Ser. No. 62/680,245, filed Jun. 4, 2018 and co-pending International Patent Application No. PCT/US2019/013277, filed Jan. 11, 2019, both entitled CHARGE DETECTION MASS SPECTROMETRY WITH REAL TIME ANALYSIS AND SIGNAL OPTIMIZATION, the disclosures of which are both expressly incorporated herein by reference in their entireties.

It will be still further understood that the orbitrap 110 in a system, such as any of the systems 200, 210 illustrated in the attached figures and described herein, may be provided in the form of at least one orbitrap array having two or more orbitraps, and that the concepts described herein are directly applicable to systems including one or more such orbitrap arrays. Examples of some such array structures in which two or more orbitraps 110 may be arranged are illustrated and described in U.S. Patent Application Ser. No. 62/680,315, filed Jun. 4, 2018 and in co-pending International Patent Application No. PCT/US2019/013283, filed Jan. 11, 2019, both entitled ION TRAP ARRAY FOR HIGH THROUGHPUT CHARGE DETECTION MASS SPECTROMETRY, the disclosures of which are both expressly incorporated herein by reference in their entireties.

While this disclosure has been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected. For example, some improvements in single ion charge detection accuracy in an orbitrap have been described which include designing various orbitrap component geometries to achieve specified geometry goals. Other improvements in single ion charge detection accuracy in an orbitrap have also been described which include split the inner electrode into identical axial halves and using the two inner electrode halves as a second ion charge detector, wherein charge detection signals measured on the outer electrodes are combined with charge detection signals measured on the inner electrodes to produce a composite charge detection signal. In accordance with this disclosure, it will be understood that in some embodiments either set of improvements may be implemented in an orbitrap to the exclusion of the other, and that in other embodiments both sets of improvements may be implemented together in an orbitrap.

What is claimed is:

1. An orbitrap, comprising:

an elongated inner electrode defining a longitudinal axis centrally therethrough and a transverse plane centrally therethrough normal to the longitudinal axis, the inner electrode having a curved outer surface defining a maximum radius $R_1$ about the longitudinal axis through which the transverse plane passes, an elongated outer electrode having a curved inner surface defining a maximum radius $R_2$ about the longitudinal axis through which the transverse plane passes, wherein $R_2>R_1$ such that a cavity is defined between the inner surface of the outer electrode and the outer surface of the inner electrode, and means for establishing an electric field configured to trap an ion in the cavity and cause the trapped ion to rotate about, and oscillate axially along, the inner electrode, wherein the rotating and oscillating ion induces a charge on at least one of the inner and outer electrode, wherein $R_1$ and $R_2$ are selected to have values that maximize a percentage of the induced charge as a function of $\ln(R_2/R_1)$.

2. The orbitrap of claim 1, wherein the orbitrap defines a characteristic radius $R_m$ about the longitudinal axis corresponding to a radial distance from the longitudinal axis at which the established electric field no longer attracts ions toward the longitudinal axis, and wherein $R_m$ and $R_2$ are selected to have values that maximize the percentage of the induced charge as a function of $R_m/R_2$.

3. The orbitrap of claim 1, wherein the outer surface of the inner electrode defines an axially-extending, spindle-like contour with the maximum radius $R_1$ at a longitudinal middle thereof, and wherein the inner surface of the outer electrode follows the contour of the outer surface of the inner electrode with the maximum radius $R_2$ at a longitudinal middle thereof such that the maximum radius $R_2$ of the inner surface of the outer electrode is radially opposite the maximum radius $R_1$ of the outer surface of the inner electrode.

4. The orbitrap of claim 1, wherein the inner electrode comprises a unitary member, and the outer electrode comprises two axially spaced apart outer electrode halves with the transverse plane passing therebetween, and wherein the rotating and oscillating ion induces a charge on each of the outer electrode halves, and further comprising charge detection circuitry configured to detect the charges induced by the rotating and oscillating ion on the outer electrode halves, and to combine the detected charges for each oscillation to produce a measured ion charge signal.

5. The orbitrap of claim 4, wherein the charge detection circuitry is configured to combine the detected charges by subtracting the charge induced on one of the outer electrode halves from the charge induced on the other of the outer electrode halves, and further comprising a processor configured to process the measured ion charge signal to determine a mass-to-charge ratio of the ion as a function of a frequency of harmonic oscillations of the ion along the longitudinal axis, to determine a charge of the ion based on the measured ion charge signal and to determine a mass of the ion based on the determined charge and the determined mass-to-charge ratio.

6. The orbitrap of claim 1, wherein the inner electrode comprises two axially spaced apart inner electrode halves with the transverse plane passing therebetween, and the outer electrode comprises two axially spaced apart outer electrode halves with the transverse plane passing therebetween, and wherein the rotating and oscillating ion induces a charge on each of the outer electrode halves and on each of the inner electrode halves, and further comprising charge detection circuitry configured to detect the charges induced by the rotating and oscillating ion on the outer electrode halves and on the inner electrode halves, and to combine the detected charges for each oscillation to produce a measured ion charge signal.

7. The orbitrap of claim 6, wherein the charge detection circuitry is configured to combine the detected charges by subtracting a sum of the charge induced on the inner electrode half and the charge induced on the outer electrode half on one side of the transverse plane from a sum of the charge induced on the inner electrode half and the charge induced on the outer electrode half on the other side of the transverse plane.

8. The orbitrap of claim 6, wherein the charge detection circuitry is configured to combine the detected charges by summing a difference of the charge induced on one of the inner electrode halves and a charge induced on the other of the inner electrode halves and a difference of the charge induced on one of the outer electrode halves and a charge induced on the other of the outer electrode halves.

9. The orbitrap of claim 6, wherein the charge detection circuitry comprises:

circuitry for converting the detected charges on each of the inner and outer electrode halves to digital charge detection values, and a processor for combining the digital charge detection values to produce the measured charge detection signal in the form of a digital measured charge detection value.

10. An orbitrap, comprising:

an elongated inner electrode defining a longitudinal axis centrally therethrough and a transverse plane centrally therethrough normal to the longitudinal axis, an elongated outer electrode defining a curved inner surface having a maximum radius $R_2$, about the longitudinal axis, through which the transverse plane passes, wherein a cavity is defined between an outer surface of the inner electrode and the inner surface of the outer electrode, means for establishing an electric field configured to trap an ion in the cavity and to cause the trapped ion to rotate about, and oscillate axially along, the inner electrode, wherein the rotating and oscillating ion induces a charge on at least one of the inner and outer electrode, and a characteristic radius $R_m$, about the longitudinal axis, corresponding to a radial distance from the longitudinal axis at which the established electric field no longer attracts ions toward the longitudinal axis, wherein values of $R_m$ and $R_2$ are selected to maximize a percentage of the induced charge as a function of $(R_m/R_2)$.

11. The orbitrap of claim 10, wherein the inner electrode comprises a unitary member, and the outer electrode comprises two axially spaced apart outer electrode halves with the transverse plane passing therebetween, and wherein the rotating and oscillating ion induces a charge on each of the outer electrode halves, and further comprising charge detection circuitry configured to detect the charges induced by the rotating and oscillating ion on the outer electrode halves, and to combine the detected charges for each oscillation to produce a measured ion charge signal.

12. The orbitrap of claim 11, wherein the charge detection circuitry is configured to combine the detected charges by subtracting the charge induced on one of the outer electrode halves from the charge induced on the other of the outer electrode halves, and further comprising a processor configured to process the measured ion charge signal to determine a mass-to-charge ratio of the ion as a function of a frequency of harmonic oscillations of the ion along the longitudinal axis, to determine a charge of the ion based on the measured ion charge signal and to determine a mass of the ion based on the determined charge and the determined mass-to-charge ratio.

13. The orbitrap of claim 10, wherein the inner electrode comprises two axially spaced apart inner electrode halves with the transverse plane passing therebetween, and the outer electrode comprises two axially spaced apart outer electrode halves with the transverse plane passing therebetween, and wherein the rotating and oscillating ion induces a charge on each of the outer electrode halves and on each of the inner electrode halves, and further comprising charge detection circuitry configured to detect the charges induced by the rotating and oscillating ion on the inner electrode halves and on the outer electrode halves, and to combine the detected charges for each oscillation to produce a measured ion charge signal.

14. The orbitrap of claim 13, wherein the charge detection circuitry is configured to combine the detected charges by subtracting a sum of the charge induced on the inner electrode half and the charge induced on the outer electrode half on one side of the transverse plane from a sum of the charge induced on the inner electrode half and the charge induced on the outer electrode half on the other side of the transverse plane.

15. The orbitrap of claim 13, wherein the charge detection circuitry is configured to combine the detected charges by summing a difference of the charge induced on one of the inner electrode halves and the charge induced on the other of the inner electrode halves and a difference of the charge induced on one of the outer electrode halves from the charge induced on the other of the outer electrode halves.

16. The orbitrap of claim 13, wherein the charge detection circuitry comprises:

circuitry for converting the detected charges on each of the inner and outer electrode halves to digital charge detection values, and a processor for combining the digital charge detection values to produce the measured charge detection signal in the form of a digital measured charge detection value.

17. The orbitrap of claim 10, wherein an outer surface of the inner electrode defines an axially-extending, spindle-like contour with a maximum radius $R_1$ about the longitudinal axis at a longitudinal middle thereof, and wherein the inner surface of the outer electrode follows the contour of the outer surface of the inner electrode with the maximum radius $R_2$ at a longitudinal middle thereof such that the maximum radius $R_2$ of the inner surface of the outer electrode is radially opposite the maximum radius $R_1$ of the inner electrode.

18. An orbitrap, comprising:

an elongated inner electrode defining a longitudinal axis centrally therethrough and a transverse plane centrally therethrough normal to the longitudinal axis, the inner electrode defining two axially spaced apart inner electrode halves with the transverse plane passing therebetween, an elongated outer electrode defining two axially spaced apart outer electrode halves with the transverse plane passing therebetween, a cavity defined radially about the longitudinal axis and axially along the inner and outer electrodes between an outer surface of the inner electrode and an inner surface of the outer electrode, means for establishing an electric field configured to trap an ion in the cavity and to cause the trapped ion to rotate about, and oscillate axially along, the inner electrode, wherein the rotating and oscillating ion induces charges on the inner and outer electrode halves, and charge detection circuitry configured to detect first and second charges induced by the rotating and oscillating ion on the inner electrode halves respectively, and to detect third and fourth charges induced by the rotating and oscillating ion on the outer electrode halves respectively, and to combine the detected first, second, third and fourth charges for each oscillation to produce a measured ion charge signal.

19. The orbitrap of claim 18, wherein an outer surface of the inner electrode defines an axially-extending, spindle-like contour having a maximum radius $R_1$ about the longitudinal axis at a longitudinal middle thereof, and wherein the inner surface of the outer electrode follows the contour of the outer surface of the inner electrode with a maximum radius $R_2$ about the longitudinal axis at a longitudinal middle thereof, wherein $R2>R_1$ and the maximum radius $R_2$ of the inner surface of the outer electrode is radially opposite the maximum radius $R_1$ of the inner electrode, and wherein $R_1$ and $R_2$ are selected to have values that maximize a percentage of the induced charges as a function of $\ln(R_2/R_1)$.

20. The orbitrap of claim 19, wherein the orbitrap defines a characteristic radius $R_m$ about the longitudinal axis corresponding to a radial distance from the longitudinal axis at which the established electric field no longer attracts ions toward the longitudinal axis, and wherein $R_m$ and $R_2$ are selected to have values that maximize the percentage of the induced charges as a function of $R_m/R_2$.

* * * * *